US007234203B2

(12) United States Patent
Latimer et al.

(10) Patent No.: US 7,234,203 B2
(45) Date of Patent: Jun. 26, 2007

(54) LOCKING HINGE FOR FOLDING LADDER

(75) Inventors: Brett A. Latimer, New Castle, PA (US); Ronald K. Burig, New Castle, PA (US); Christine A. Brown, Jamestown, PA (US); David E. Plotner, Sharpsville, PA (US); John J. Fiumefreddo, New Wilmington, PA (US); Roy B. Bendickson, Sharpsville, PA (US); Joseph C. Dangrow, Fredonia, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 10/635,896

(22) Filed: Aug. 7, 2003

(65) Prior Publication Data

US 2005/0028320 A1 Feb. 10, 2005

(51) Int. Cl.
*E05F 1/08* (2006.01)

(52) U.S. Cl. ..... 16/297; 16/231; 182/163; 182/22; 182/21; 403/93

(58) Field of Classification Search ..... 16/297, 16/231 X, 292, 326, 324, 332, 349; 292/DIG. 17; 403/93; 182/163, 21, 22, 24
See application file for complete search history.

(56) References Cited

U.S. PATENT DOCUMENTS

| | | | | |
|---|---|---|---|---|
| 2,649,237 | A | 8/1953 | Bjorklund et al. | |
| 2,722,360 | A * | 11/1955 | Malm | 182/214 |
| 2,852,176 | A | 9/1958 | Harmon | |
| 3,143,185 | A * | 8/1964 | Wenger | 182/24 |
| 3,187,373 | A * | 6/1965 | Fisher | 16/324 |
| 3,554,318 | A * | 1/1971 | Knight | 182/24 |
| 3,565,211 | A * | 2/1971 | Le Blanc | 182/211 |
| 3,655,012 | A * | 4/1972 | Hoffman et al. | 182/163 |
| 3,730,295 | A * | 5/1973 | Deese | 182/163 |
| 3,811,151 | A * | 5/1974 | Kuemmerlin | 16/329 |
| 3,861,499 | A * | 1/1975 | Follett, Jr. | 182/163 |
| 3,955,240 | A * | 5/1976 | Schuh et al. | 16/326 |
| 4,152,810 | A | 5/1979 | Martinez | |
| 4,281,743 | A | 8/1981 | Fuller | |
| 4,457,391 | A * | 7/1984 | Alimbau Marques | 182/164 |
| 4,541,508 | A | 9/1985 | Lundh | |
| 4,719,990 | A * | 1/1988 | Markovic | 182/163 |
| 4,736,490 | A * | 4/1988 | Wesselski | 16/292 |
| 4,770,559 | A * | 9/1988 | Yoo | 403/93 |
| 4,823,912 | A * | 4/1989 | Gould et al. | 182/214 |
| 4,934,485 | A * | 6/1990 | Purkapile | 182/20 |
| 5,165,501 | A * | 11/1992 | Donahey | 182/214 |
| 6,330,733 | B1 | 12/2001 | Rauschenberger | |
| 6,688,797 | B2 * | 2/2004 | Park et al. | 403/93 |

* cited by examiner

*Primary Examiner*—Brian E. Glessner
*Assistant Examiner*—Mark Williams
(74) *Attorney, Agent, or Firm*—McDermott Will & Emery LLP

(57) ABSTRACT

A hinge for a folding ladder including a hinge latch movable between a locked position and an unlocked position disposed within a hinge latch cavity. The hinge latch includes a first locking portion protruding therefrom, an elongated slot formed configured to slidingly receive a hinge shaft, a first opening configured to receive a first biasing member, and a second opening configured to receive a locking member. Rotational movement of one hinge casing relative to another hinge casing is prevented by engagement of the first locking portion and locking member with a respective one of the first opening and second opening.

6 Claims, 38 Drawing Sheets

LOCKING HINGE FOR FOLDING LADDER

TECHNICAL FIELD

The disclosure relates generally to hinges used in applications of folding ladders including but not limited to folding ladders configured to be disposed in an opening, such as openings in a ceiling of a house (e.g., attic ladder), openings in a ceiling of a building floor, or openings to a suspended storage space (e.g., an elevated garage storage area) to provide temporary access between one floor or space and another floor or space.

BACKGROUND

Examples of attic ladders or "disappearing stairways" are shown, for example, in U.S. Pat. Nos. 2,649,237 and 2,852,176. These ladders normally fold and retract upwardly into a frame secured between adjacent joists of the attic, and the folded ladder is covered by a door which normally extends substantially flush with the finished ceiling of the room in which the ladder is mounted. Attic ladders thus take up no floor space except when actually extended and are also inexpensive to construct, as compared with fixed stairways typically constructed on-site.

U.S. Pat. No. 4,281,743 issued to Fuller on Aug. 4, 1981 shows another conventional attic ladder. As shown in FIG. 1 attic ladder 11 includes an outside frame 12 which is mounted between adjacent floor joists 13 of the attic floor 14. Cross braces 15 are mounted between a pair of adjacent floor joists 13 to provide end support for the frame 12 of the disappearing stairway. Ladder 11 is mounted in the ceiling by securing frame 12 to the joists 13 and the cross braces 15. A cover panel 16 forms part of ladder 11 and is hinged to the outer frame 12, so that the door becomes substantially flush with the ceiling 17 when the ladder 11 is folded. A first ladder portion 17 is affixed to the inner face of cover panel 16 and a second ladder portion 18 is pivotally hinged to the first ladder portion so as to be unfolded or folded when the ladder is opened or closed. While commercially available attic ladders or disappearing stairways typically come in a number of sizes, most come in several standard widths and lengths adaptable to fit conventional constructions.

U.S. Pat. No. 4,541,508 issued to Lundh on Sep. 17, 1985 shows yet another conventional attic ladder. In FIG. 2, a foldable ladder is shown to consist of a lower section 11, a central section 12 and an upper section 13. The central section 12 is hingedly connected to the two remaining sections 11,13 by a hinge so that the central section 12 and the lower section 11 can be folded up on the upper section 13. Upper section 13 is hingedly attached to a frame 14 by hinges 15, with the folding down movement of the upper ladder section 13 being limited by a pair of toggle joints 16,17, attached to the upper ladder section and to the frame 14. Toggle joints 16,17 are rigidly connected to each other at the lower arms by means of an axle 18 extending in parallel with the rungs of the ladder and are attached to the axle outside the side rails of the ladder. The ladder is spring-biased to a closed position by a gas spring 19 connected at one end to an outside of one side rail and connected at its other end, via piston rod 19*a*, to moment arm 18*a*, which is rigidly connected to the axle 18 at such an angle that a maximum moment is generated when the door is almost entirely closed. When the point of connection between the gas spring 19 and the moment arm 18*a* has passed the line for moment centre (i.e. the connecting line between the attachment of the gas spring 19 to the ladder 13 and the axle 18, which passing takes place when the door is opened entirely), the gas spring 19 actuates the door so that it is locked in folded-down position, which is necessary because the "weight" of the door decreases as soon as the ladder sections are folded out.

However, despite the above-noted improvements to the attic ladder and disappearing stairway art, additional improvements can be realized in the structure of the attic ladder, particularly the hinges.

SUMMARY

In one aspect, a hinge is provided for a foldable ladder. The hinge includes a first hinge plate and a second hinge plate connected by a hinge latch and hinge shaft. The hinge latch is disposed within the hinge plates and is movable between a locked position and an unlocked position. Rotational movement of the first hinge plate relative to the second hinge plate is permitted when the hinge latch is secured in the unlocked position. More particularly, the hinge first and second hinge plates collectively define a latch cavity configured to receive the hinge latch. The hinge latch itself comprises a first locking portion protruding therefrom, an elongated slot formed therein to slidingly receive a hinge shaft, a first opening configured to receive a first biasing member, and a second opening configured to receive a locking member. A first biasing member is fixed, at one end, to the first opening and, at another end, extends outside of a respective hinge plate through a slot formed in the hinge plate to permit selective application of a force to the hinge latch from a point outside of the hinge. A second biasing member is disposed within the elongated slot in the hinge plate. The second biasing member is fixed, at one end, relative to the hinge shaft and is fixed, at another end, to the elongated slot. The second biasing member biases the hinge latch toward the locked position. One of the hinge plates also defines a lock opening configured to receive the first locking portion of the hinge latch.

In another aspect, a hinge includes an upper hinge casing and a lower hinge casing collectively defining an latch cavity, as well as a first lock opening and a second lock opening. The upper hinge casing and lower hinge casing and rotatably connected to one another by a hinge shaft and a hinge latch, which is movably positioned with the latch cavity to translate between a first position and a second position. The hinge latch includes a first locking portion and a second locking portion, each protruding from the hinge latch. The hinge latch also includes a lock recess, a first biasing member connector, and a second biasing member connector. The first locking portion and the second locking portion engage a respective one of the first lock opening and the second lock opening. One of the upper or lower hinge casings include a locking member positioned to engage the hinge latch lock recess when the hinge latch is moved into the second position and lock the hinge latch in the second position, wherein rotational movement of the lower hinge casing relative to the upper hinge casing is prevented by the engagement of the first locking portion and second locking portion with a respective one of the first lock opening and the second lock opening. Rotational movement of the lower hinge casing relative to the upper hinge casing is permitted when the hinge latch is locked in the second position with the first locking portion and the second locking portion positioned at least partially out of engagement with a respective one of the first and second lock openings.

Additional advantages will become readily apparent to those skilled in this art from the following detailed description, wherein only the a preferred example of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein:

FIG. 4(*b*) is a enlarged perspective view of a portion of the folding ladder depicted in FIG. 4(*a*) showing a hinge for a folding ladder in accord with the present concepts;

FIG. 15(*b*) shows a view of a opening hinge with an unlocked hinge latch, in accord with the second example of the present concepts, from a point of view outside of the left ladder rail looking in with some hinge plates removed for clarity.

FIG. 16(*b*) shows a view of an open hinge with a hinge latch, in accord with the second example of the present concepts, from a point of view outside of the right ladder rail looking in with some hinge plates removed for clarity.

DETAILED DESCRIPTION

With reference to the attached drawings, there is described a folding ladder and various features including but not limited to locking mechanisms, positioning mechanisms, and movable steps, as well as a support frame and methods of installation of the support frame and folding ladder in an opening to provide access between spaces on opposite sides of the opening.

Figure 1:
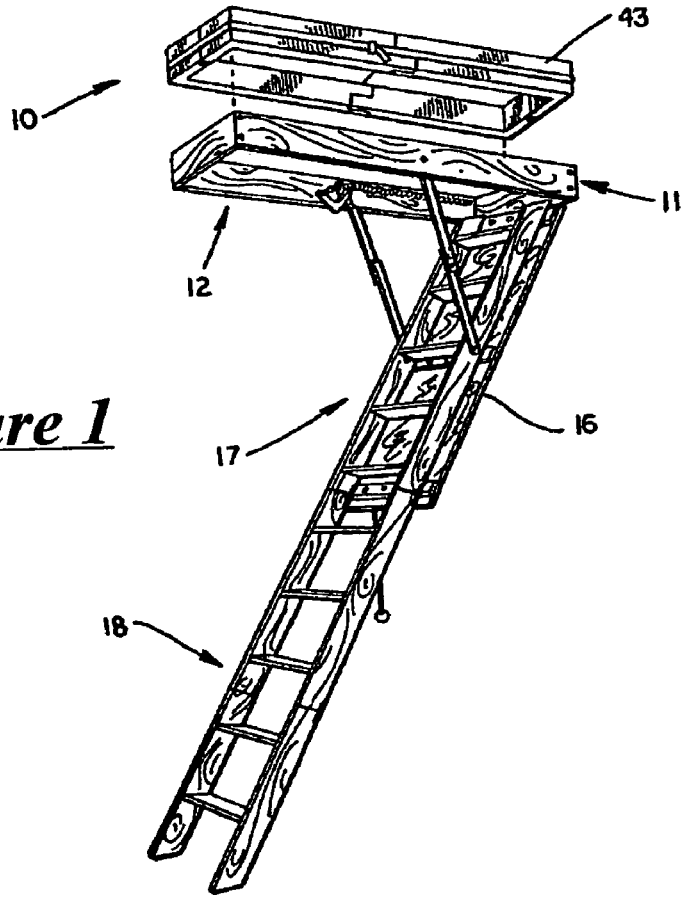
Figure 1 (Prior Art)
FIG. 1 is a perspective view of conventional folding ladder disposed in an opening.
Figure 2:
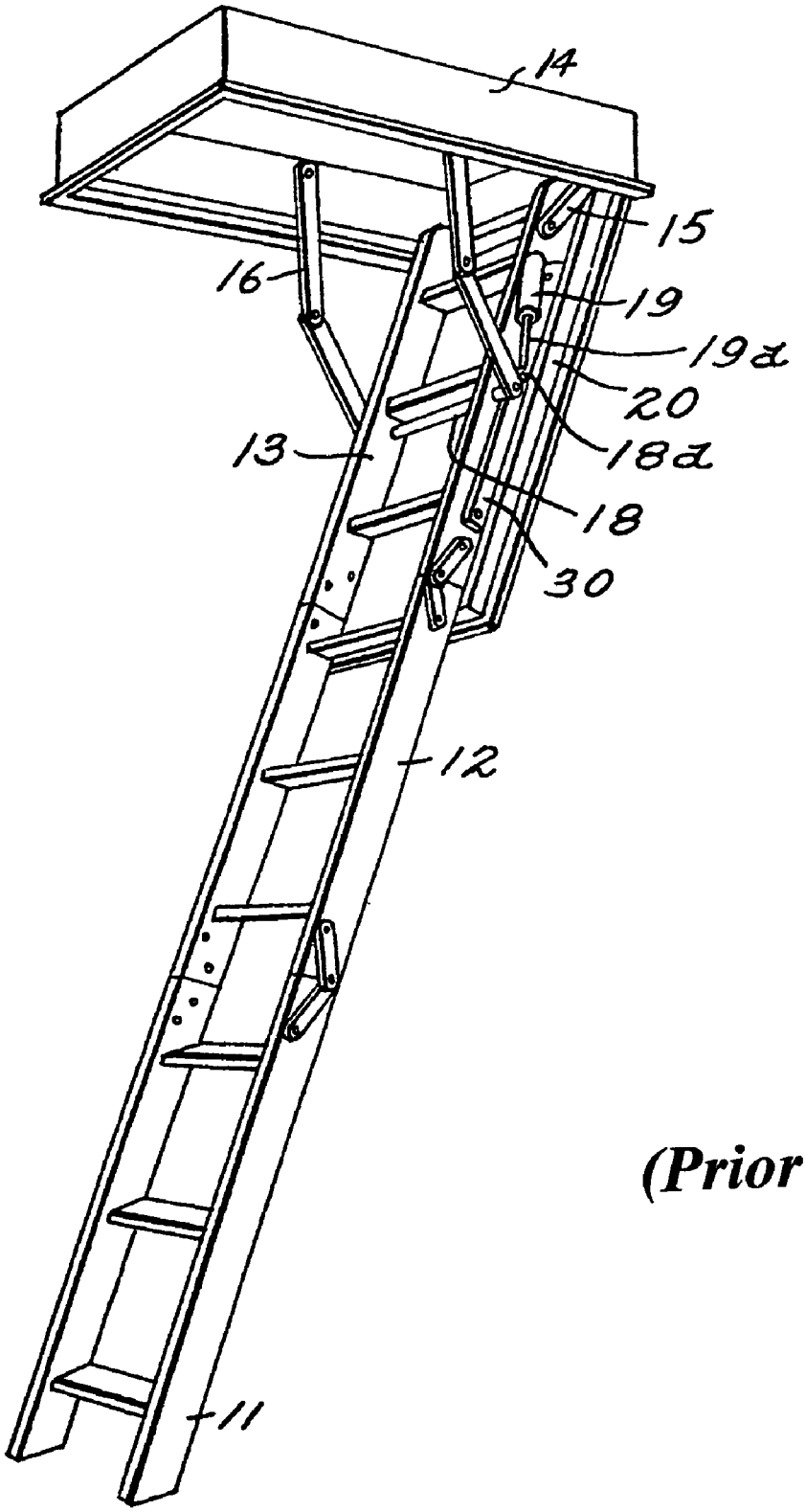
(Prior Art) Figure 2
FIG. 2 is a perspective view of another conventional folding ladder disposed in an opening.
Figure 3:
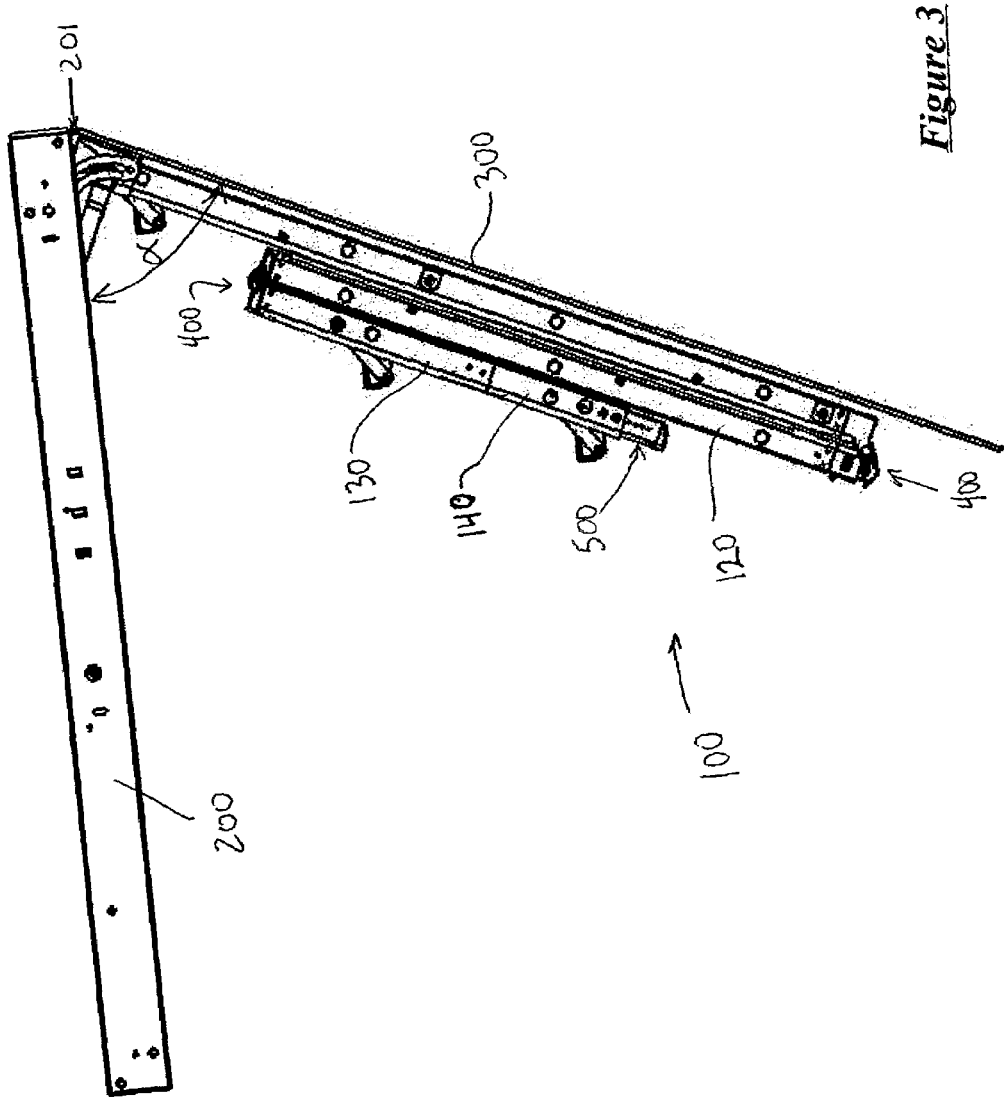
FIG. 3 is a side view of an example of folding ladder and support frame in accord with the present concepts wherein the ladder sections are in a closed position.

FIG. 3 shows an example of folding ladder 100 and support frame 200 utilizing a hinge 400 in accord with the present concepts wherein the ladder sections comprising an upper section 110, middle section 120, and lower section 130 are shown in various positions as the folding ladder is unfolded from the support frame. It is to be understood that the concepts expressed herein apply equally to a folding ladder bearing any number of folding sections, including but not limited to two or four or more, as well as folding ladders adapted for different types of installation or for stand-alone ladder structures. In the depicted example, however, support frame 200 is configured for installation within an opening, such as but not limited to an opening in a ceiling of a house (e.g., attic ladder), an opening in a ceiling of a building floor, or an opening to a suspended storage space (e.g., an elevated garage storage area) to provide access between one floor or space and another floor or space.

Upper ladder section 110 is secured to an upper side of panel 300 by one or more brackets 301 provided at upper and lower portions of upper ladder section 110. Additional conventional means of attachment to attach upper ladder section 110, such as slots, grooves, pins, wires, protrusions, recesses, and/or locking devices, may be provided to permit mating engagement between the upper ladder section 110 and a corresponding structure provided in or on an upper surface of panel 300 to prevent undesired relative movement therebetween. Panel 300 is adapted to rotate relative to support frame 200 and may alternatively be hingedly connected by a conventional hinge arrangement 201 to the support frame, as shown, and/or may simply be connected to the ladder 100, which is configured to rotate with respect to the support frame. Panel 300 is configured to substantially occlude the aforementioned opening when the ladder is in a folded and stowed position (e.g., a 0° angle α between the panel 300 and the support frame 200). Panel 300 may be configured to blend in with the surroundings (e.g., to blend in with a ceiling) for aesthetic reasons or may advantageously be configured by way of color, shape, and/or size in distinction to the surroundings so as to draw attention thereto (e.g., fire escape pathway/emergency access panel).

Figure 4A:
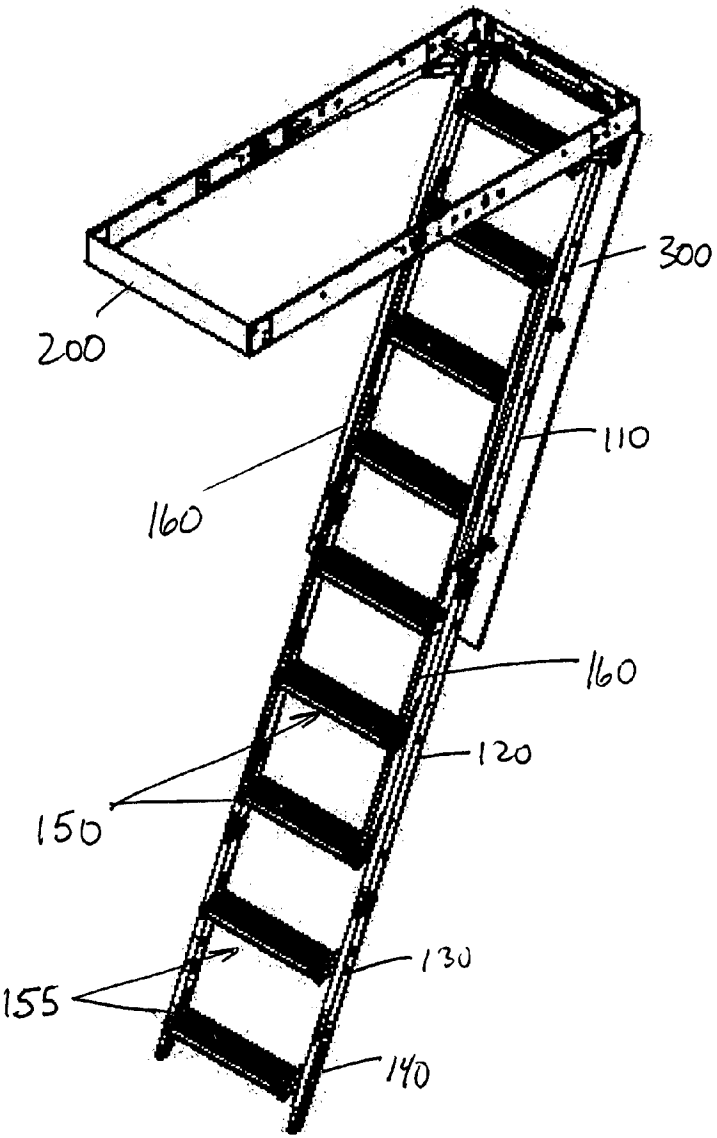
FIG. 4(*a*) is a top-perspective view of an unfolded folding ladder and support frame in accord with the present concepts.
Figure 4B:
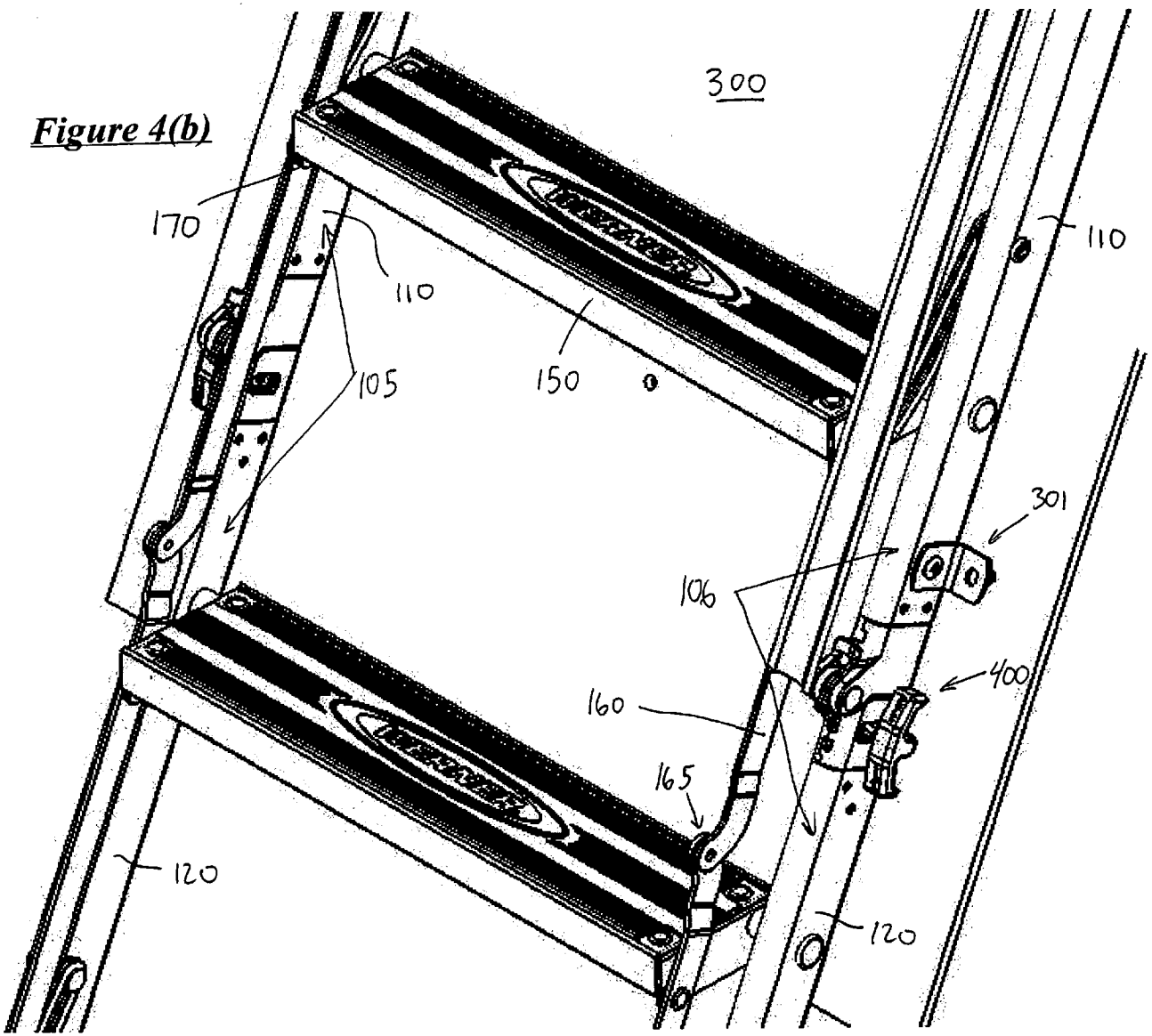

FIG. 4(*a*) illustrates a top-perspective view of an unfolded folding ladder 100 and support frame 200 utilizing a hinge 400 in accord with the present concepts. As shown more clearly in the enlarged view of FIG. 4(*b*), steps 150 are connected by joint 170 to a corresponding step rail 160. The step rails 160 are connected to one another at joints 165 and are configured to permit relative rotation between step rails 160 disposed on either side thereof. Joints 165 permit the step rails 160 to be folded over, just as the left and right ladder rails 105, 106 are permitted to be folded over one another about the hinge 400 which joins, such as shown, upper ladder sections 110 with middle ladder sections 120.

Figure 5B:
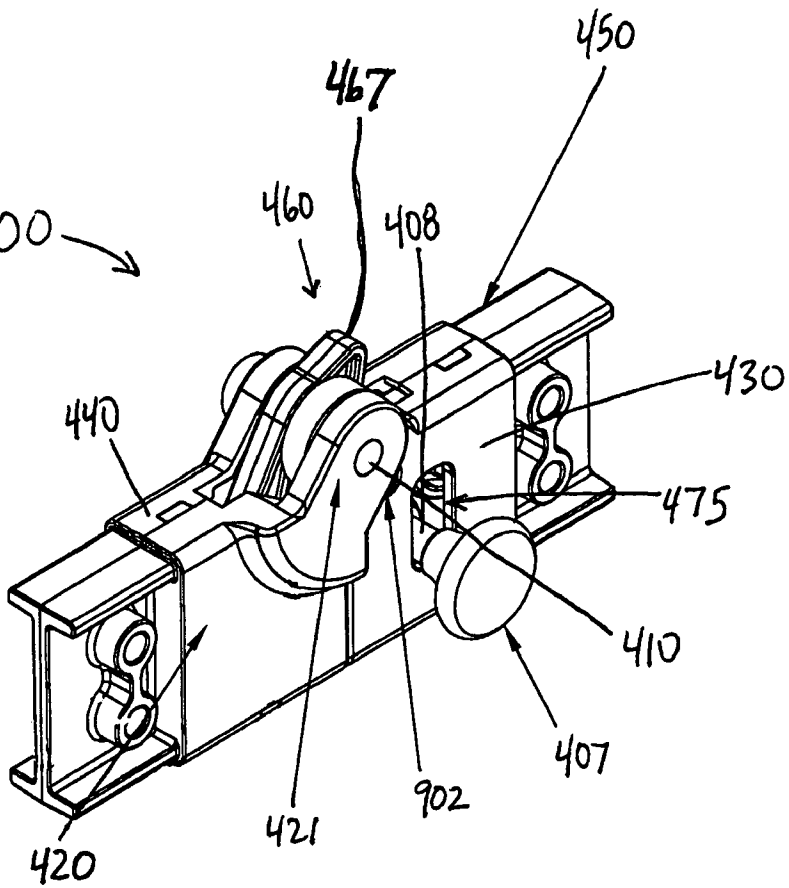
FIGS. 5(*a*)-(*b*) show left and right isometric views an assembled hinge in accord with the present concepts.
Figure 5A:
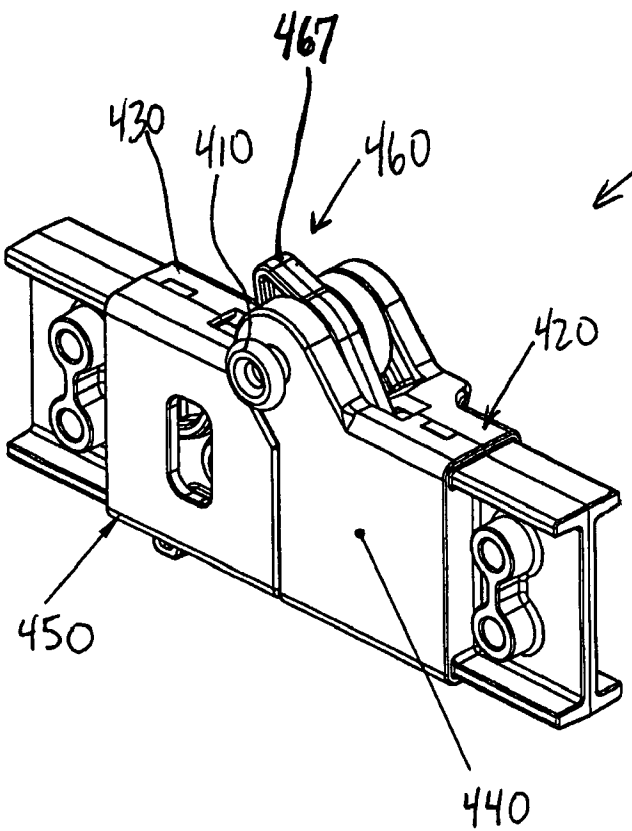
Figure 6A:
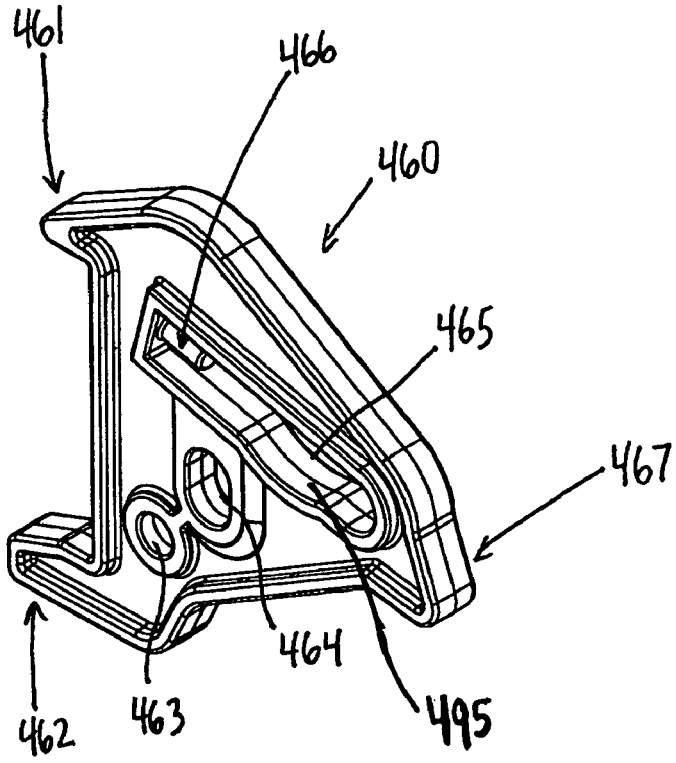
FIGS. 6(*a*)-(*f*) show views of a hinge latch in accord with the present concepts, consisting of isometric, side, cross-sectional, first enlarged detailed, second enlarged detailed, and bottom views, respectively.
Figure 6F:
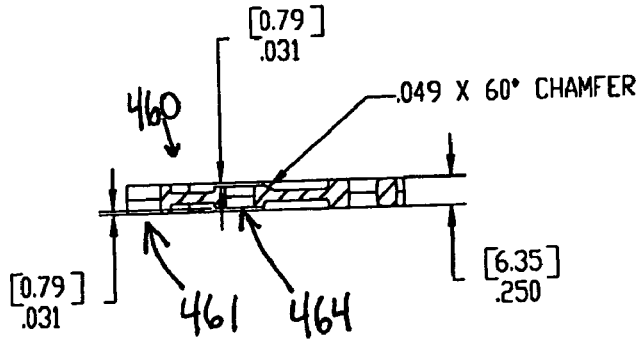
Figure 6B:
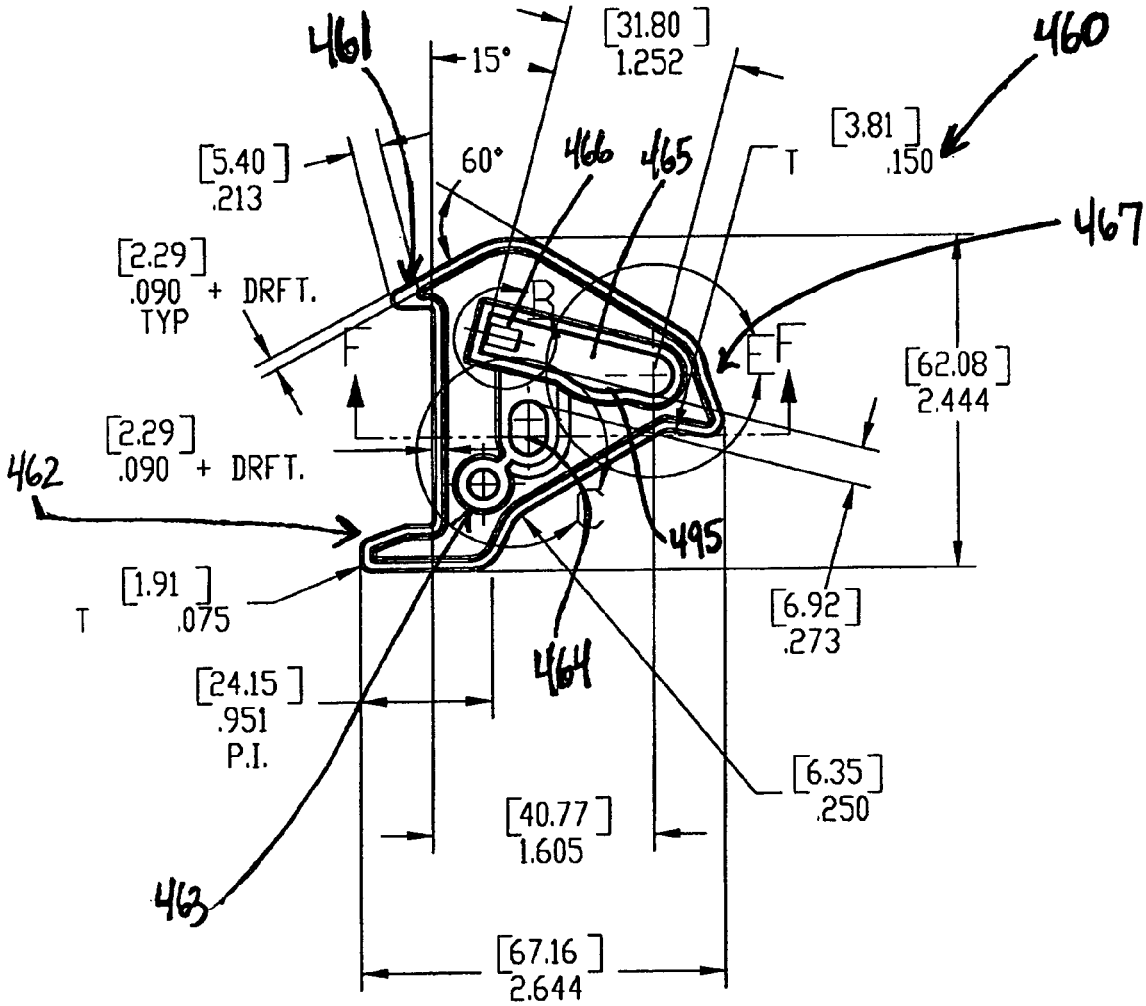
Figure 6C:
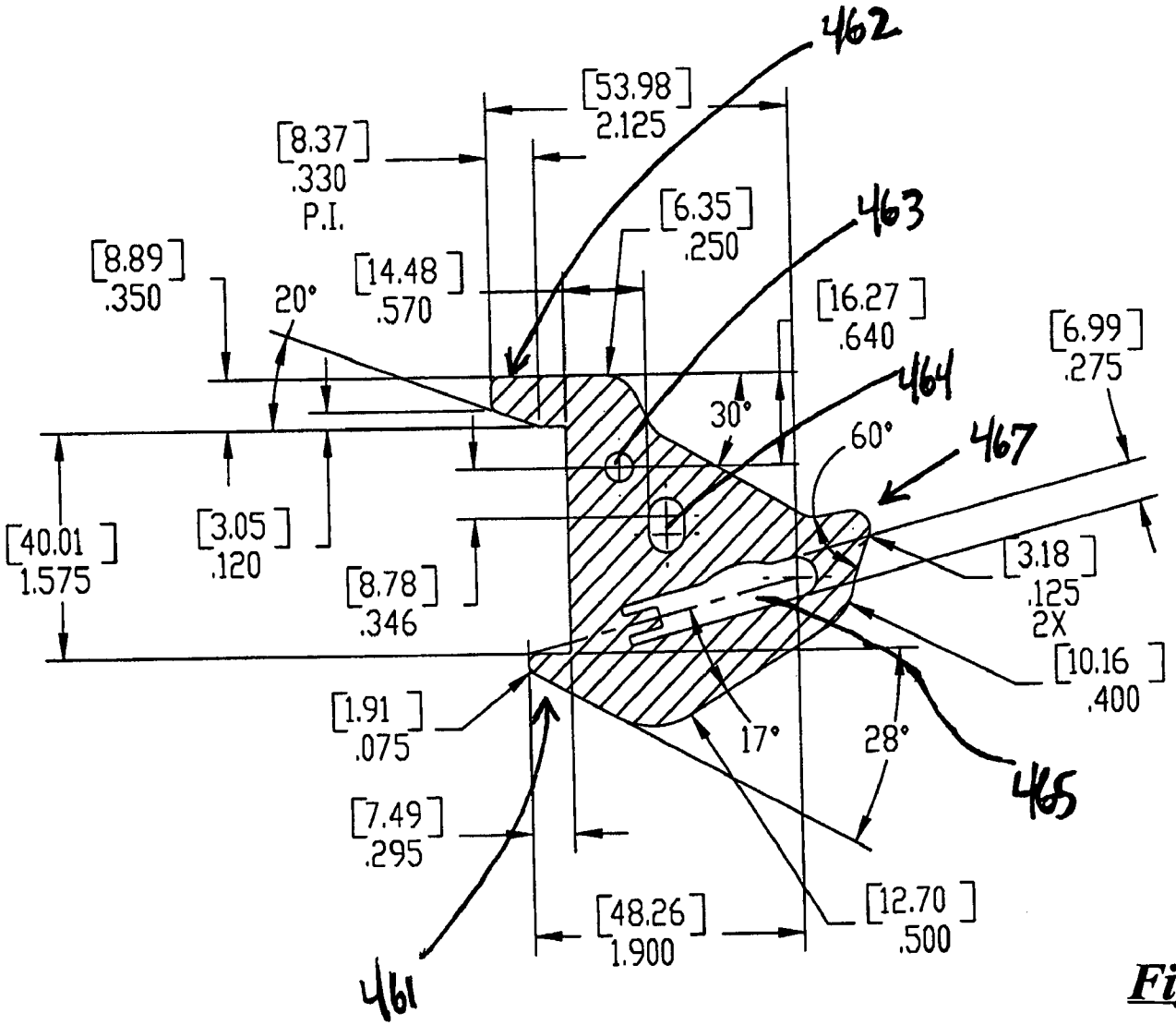
Figure 6E:
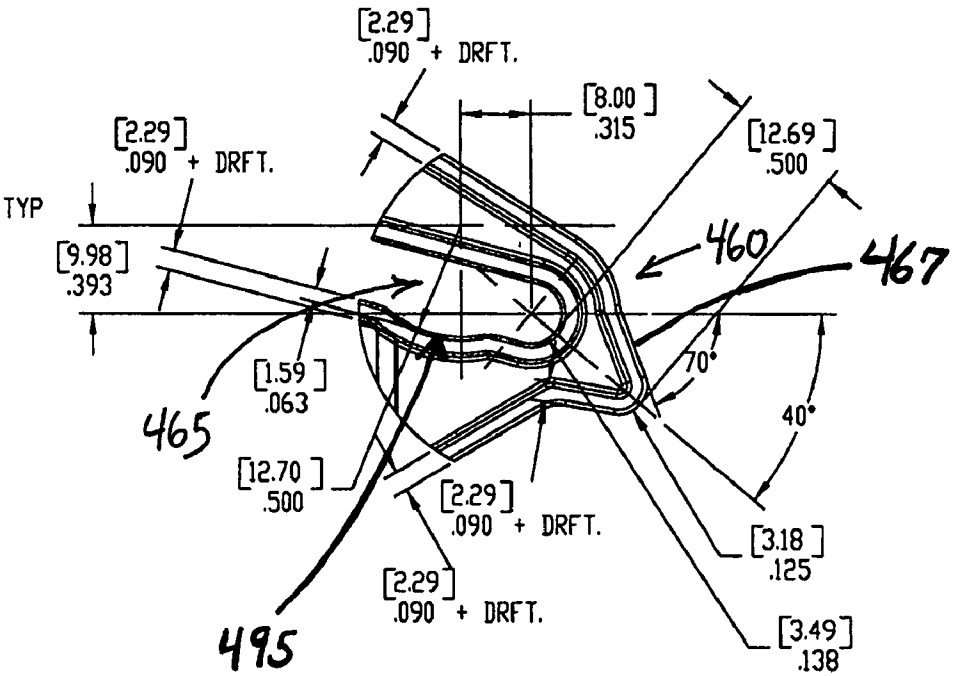
Figure 6D:
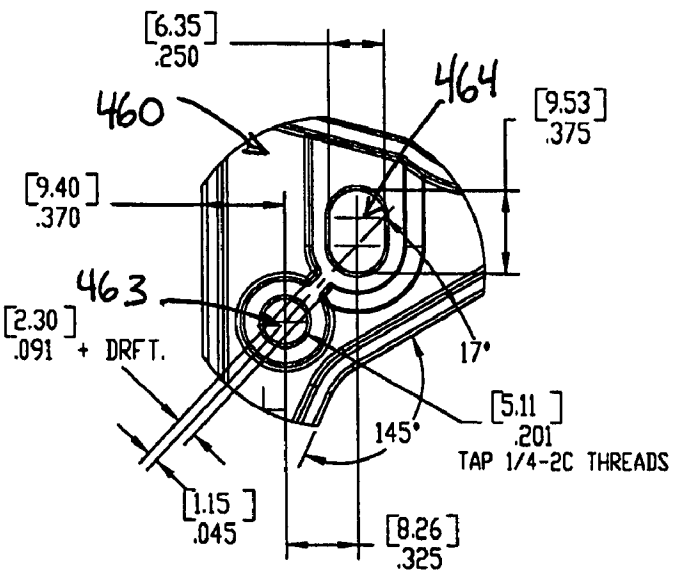
Figure 7A:
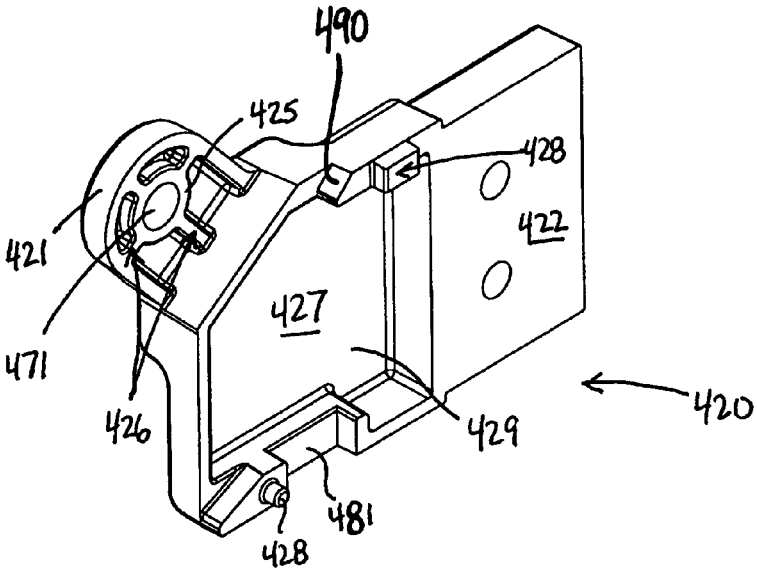
FIGS. 7(*a*)-(*h*) show views of a first hinge plate in accord with the present concepts, consisting of an isometric view, left and right side views, front and rear views, a top-down cross-sectional view, an enlarged detailed view, and a cross-sectional view taken along line B-B.
Figure 7G:
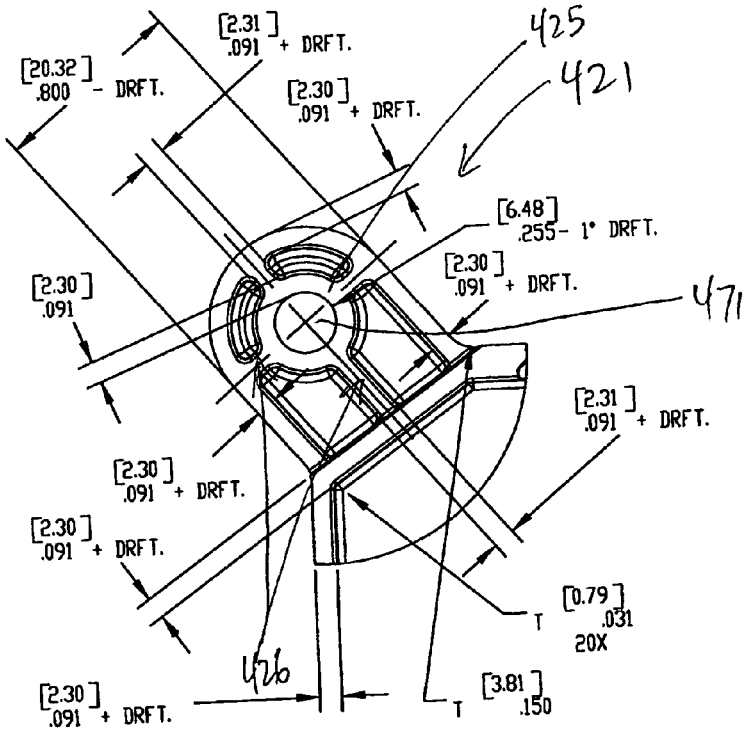
Figure 7B:
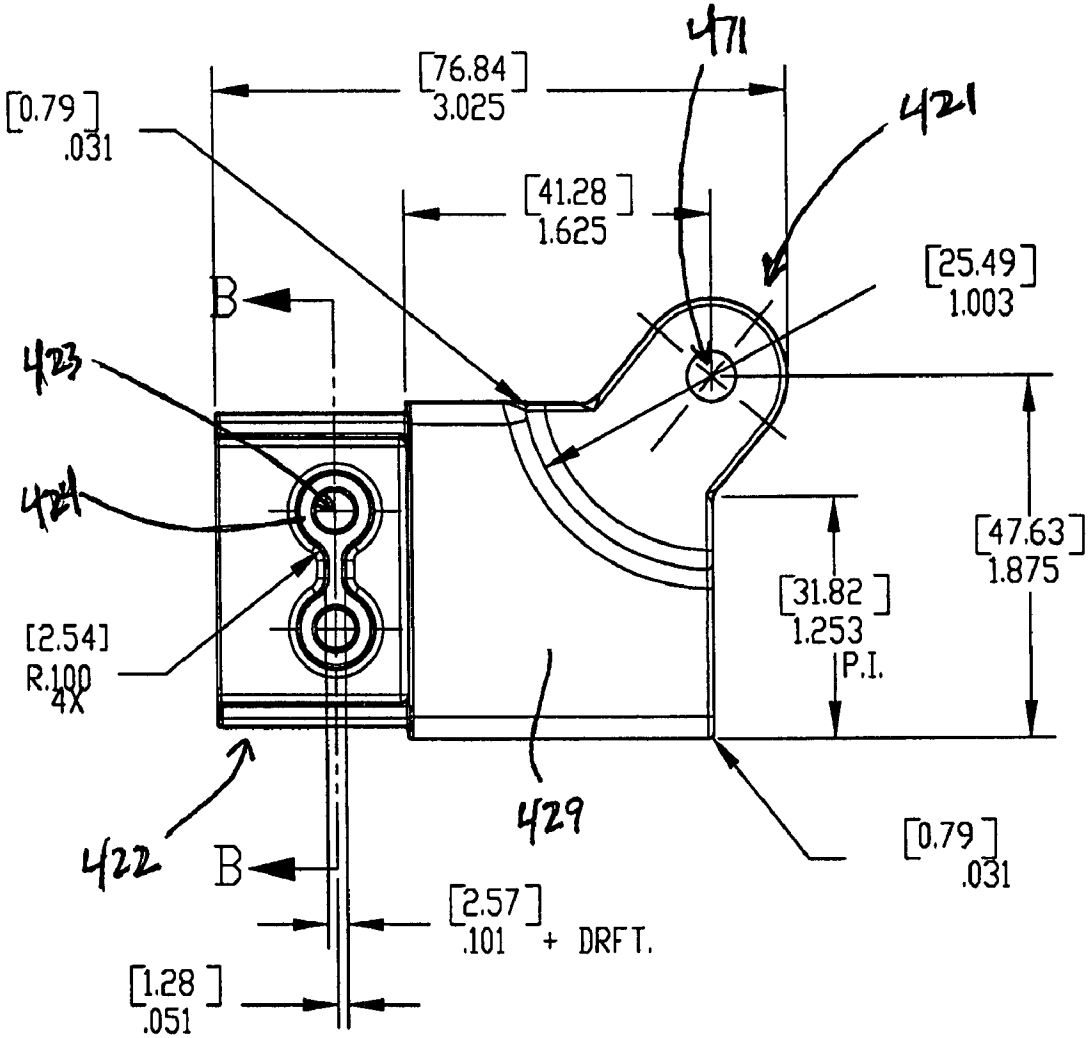
Figure 7C:
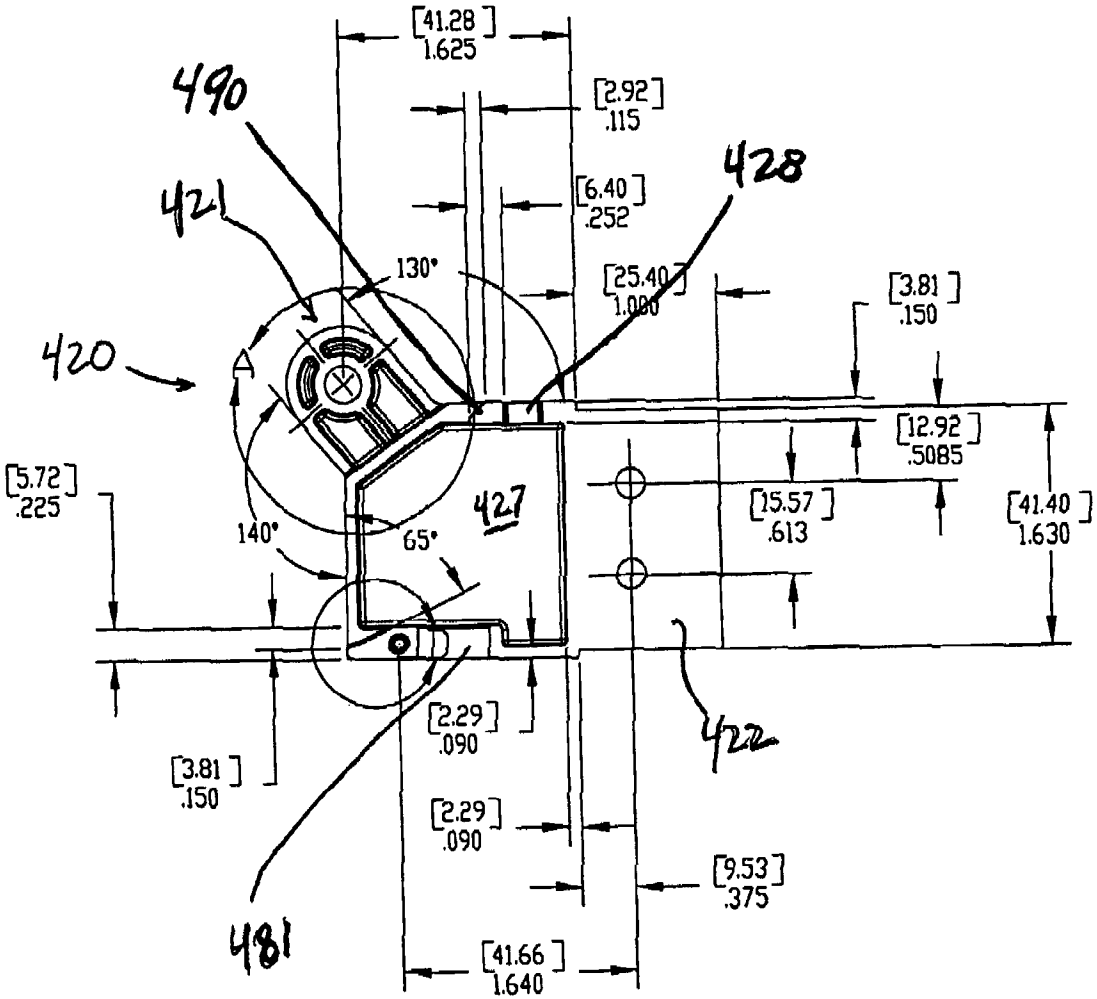
Figure 7H:
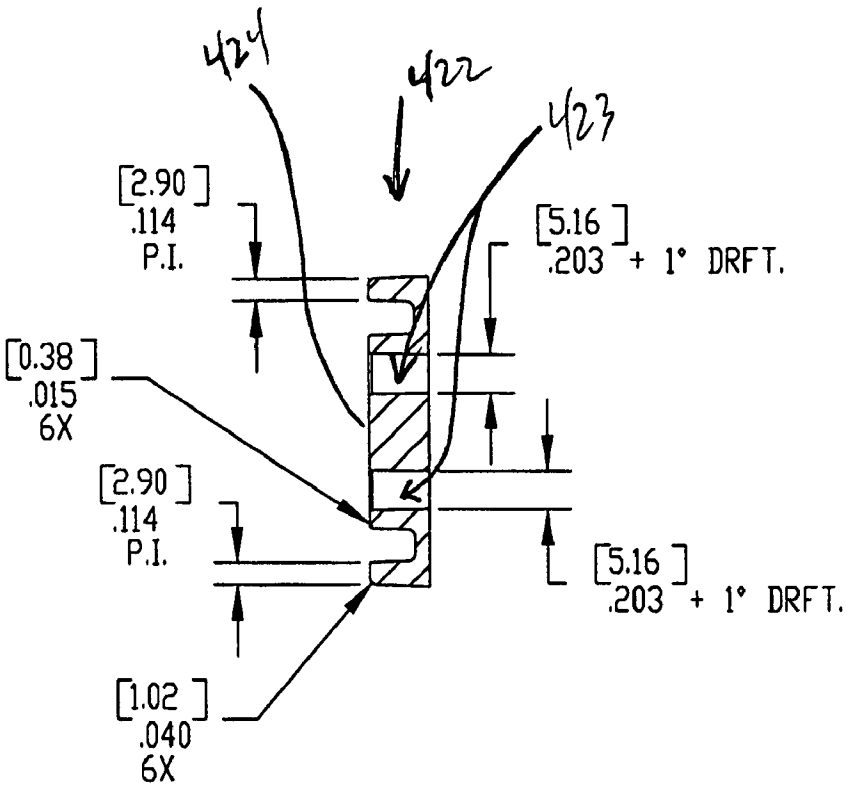
Figure 7D:
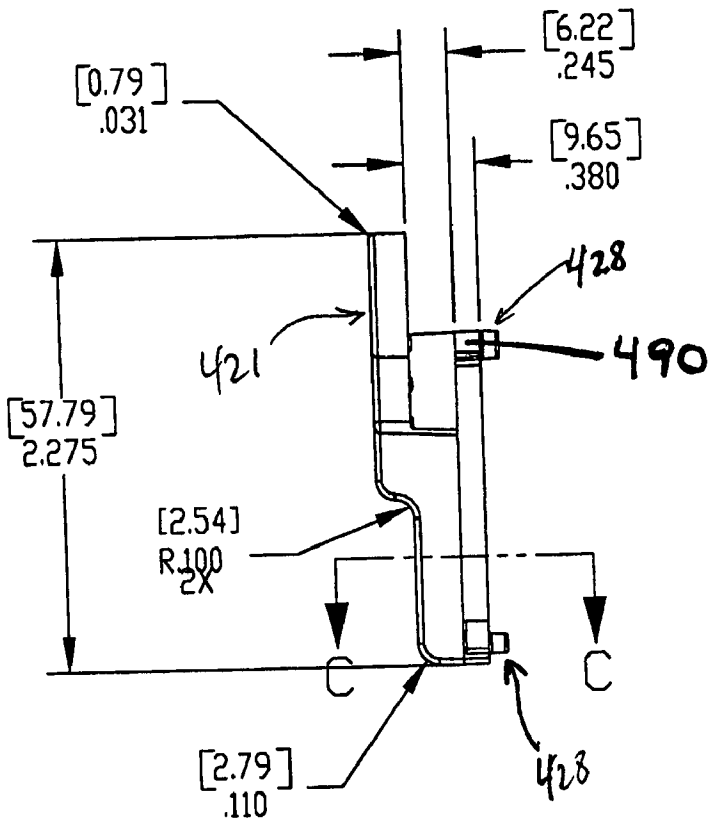
Figure 7F:
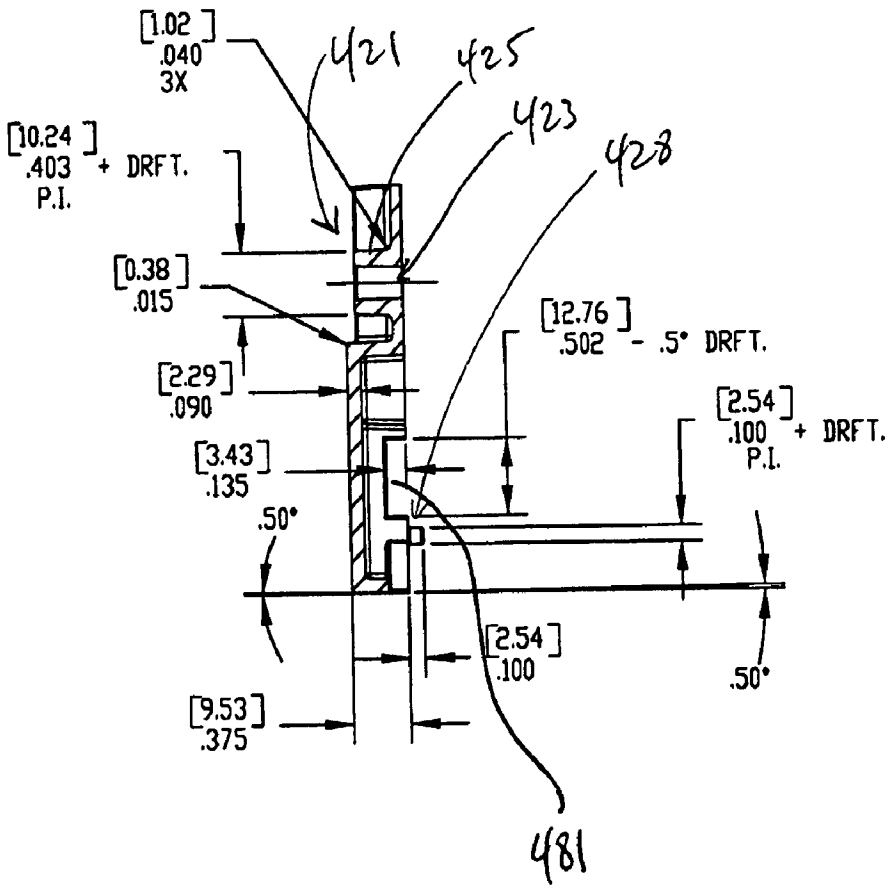
Figure 7E:
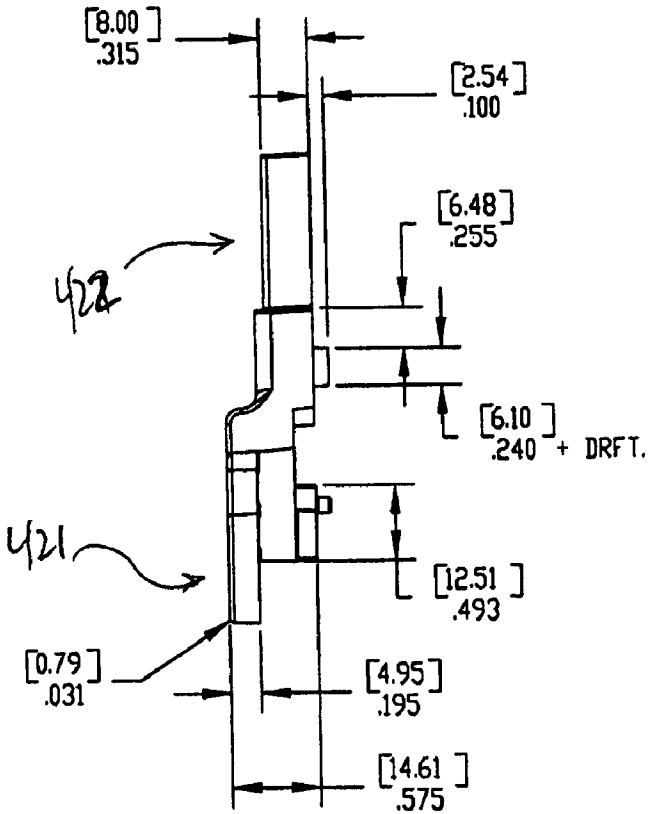
Figure 8A:
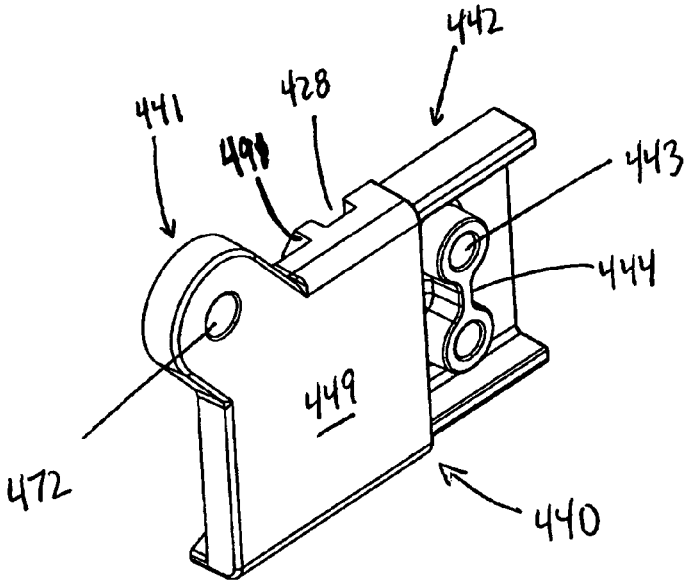
FIGS. 8(*a*)-(*g*) show views of a second hinge plate in accord with the present concepts, consisting of an isometric view, left and right side views, a top view, a front to back view, a cross-sectional view taken along line B-B in FIG. 8(*d*), a detailed view of a hinge latch support portion, and a cross-sectional view of ladder rail connecting portion taken along line D-D in FIG. 8(*c*).
Figure 8F:
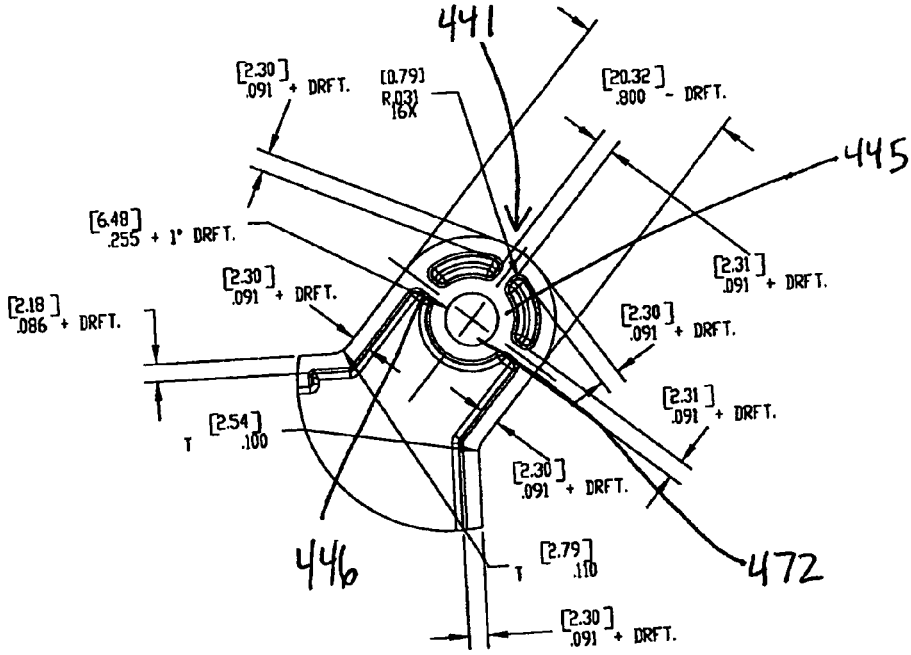
Figure 8D:
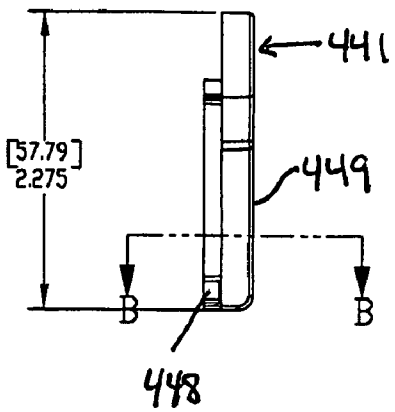
Figure 8B:
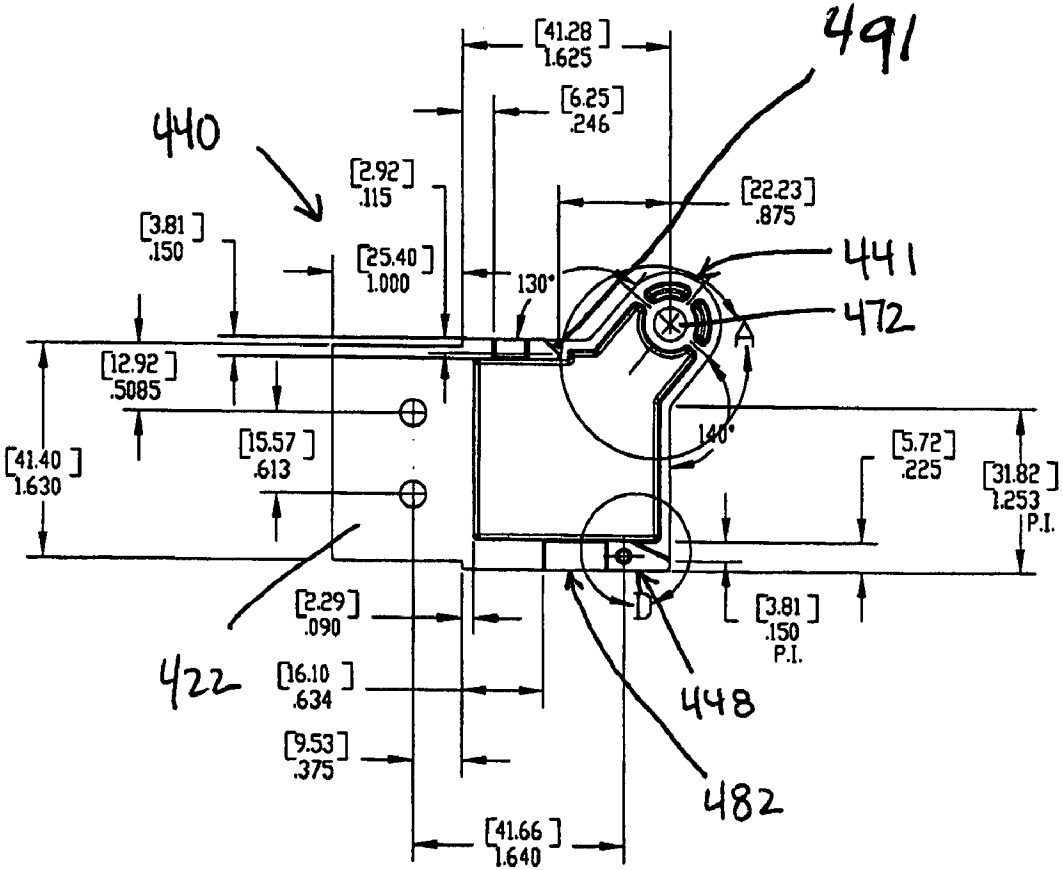
Figure 8G:
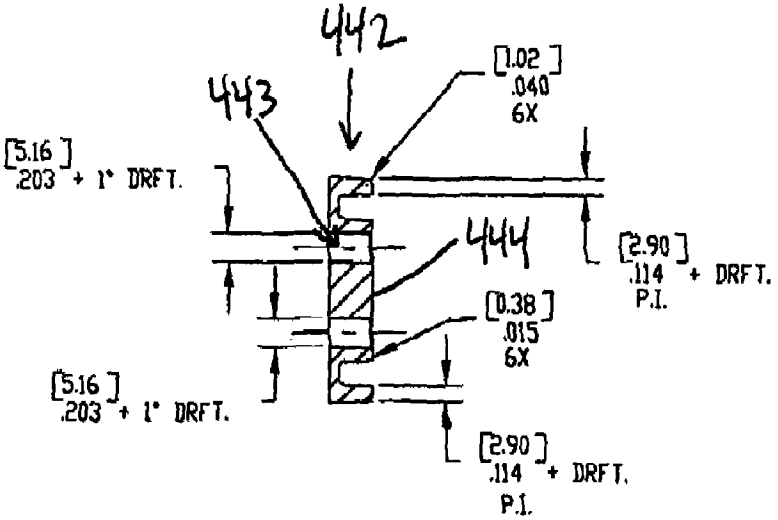
Figure 8C:
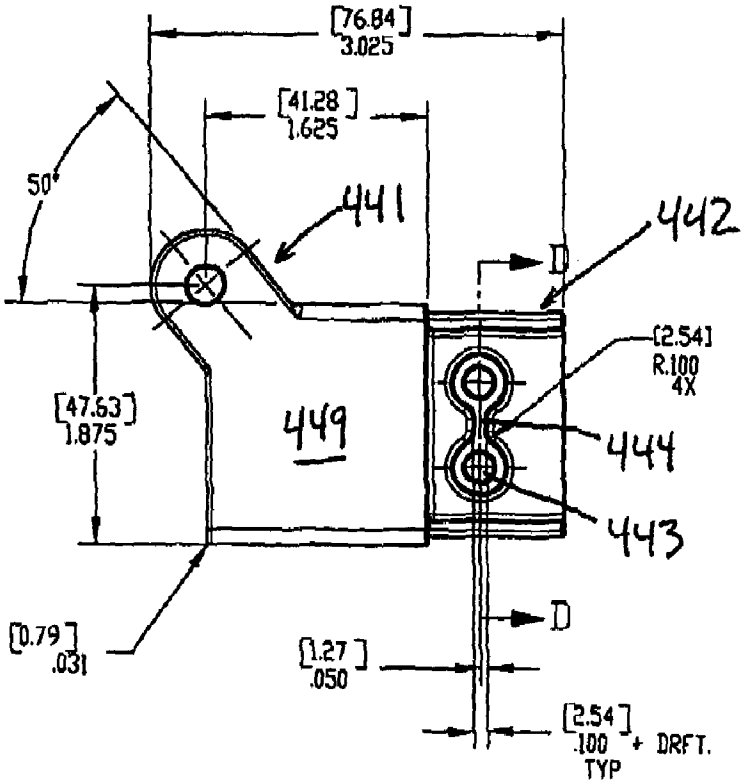
Figure 8E:
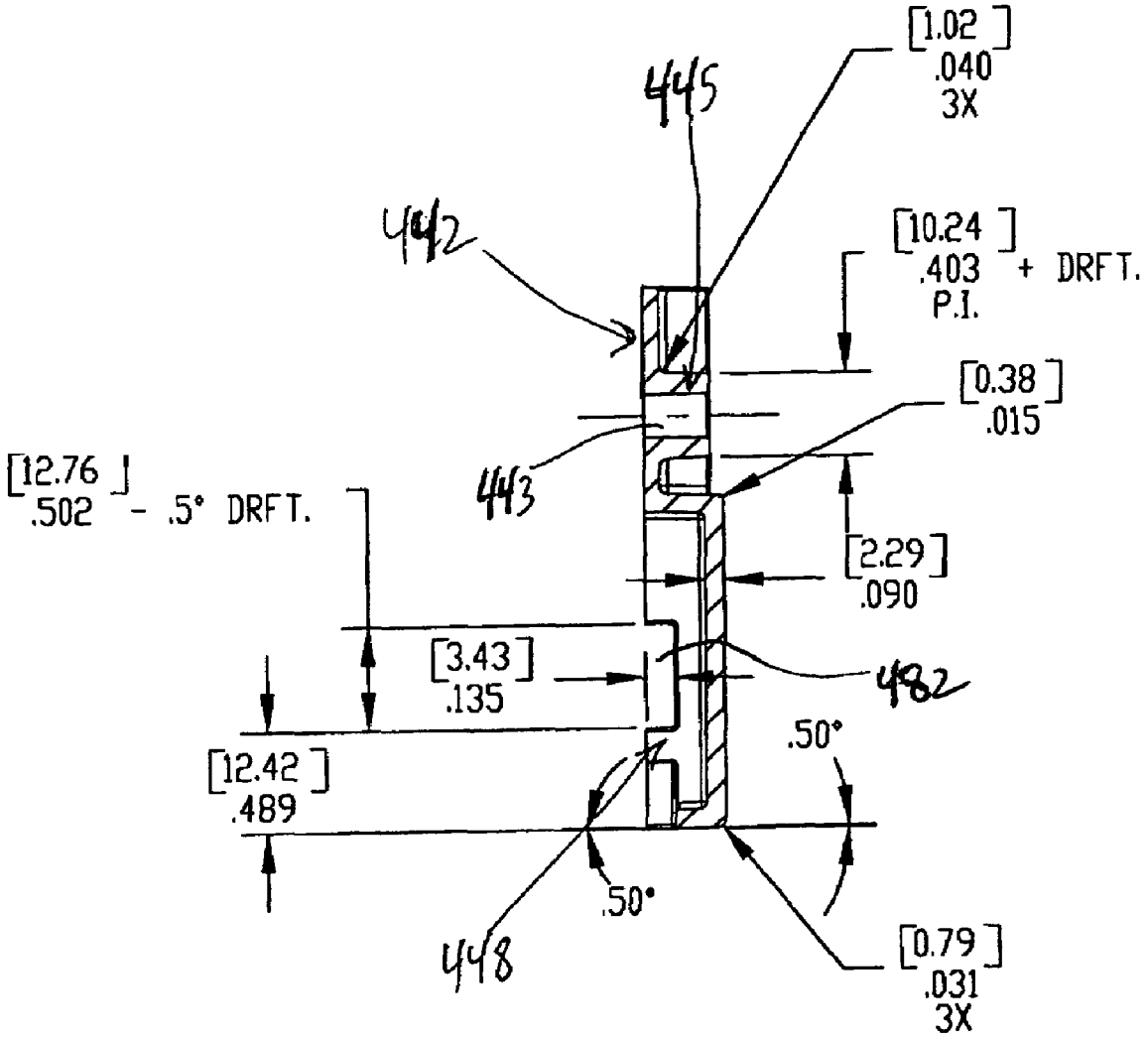
Figure 9E:
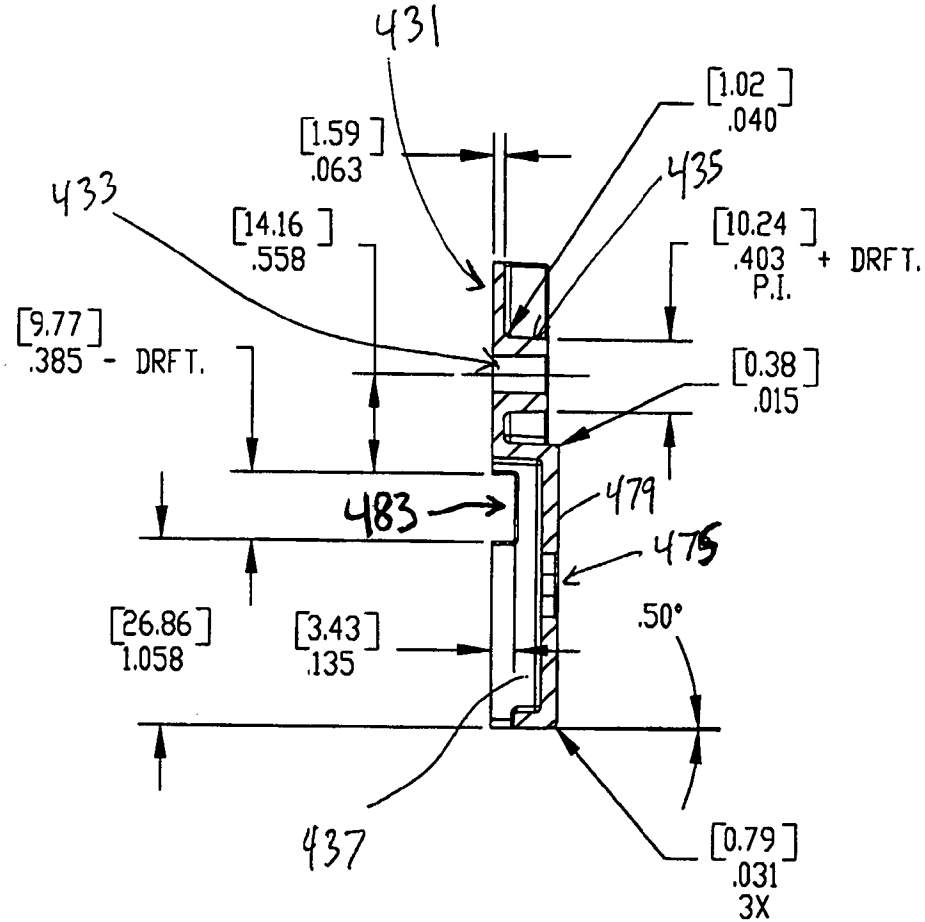
FIGS. 9(*a*)-(*i*) show views of a third hinge plate in accord with the present concepts, consisting of an isometric view, left and right side views, a front view thereof, a top-down cross-sectional view taken along line C-C in FIG. 7(*d*), a cross-sectional view taken along line D-D in FIG. 9(*c*), a detailed view of a hinge latch support portion, a cross-sectional view of ladder rail connecting portion taken along line B-B in FIG. 9(*c*), and a cross-sectional view taken along line E-E in FIG. 7(*c*).
Figure 9A:
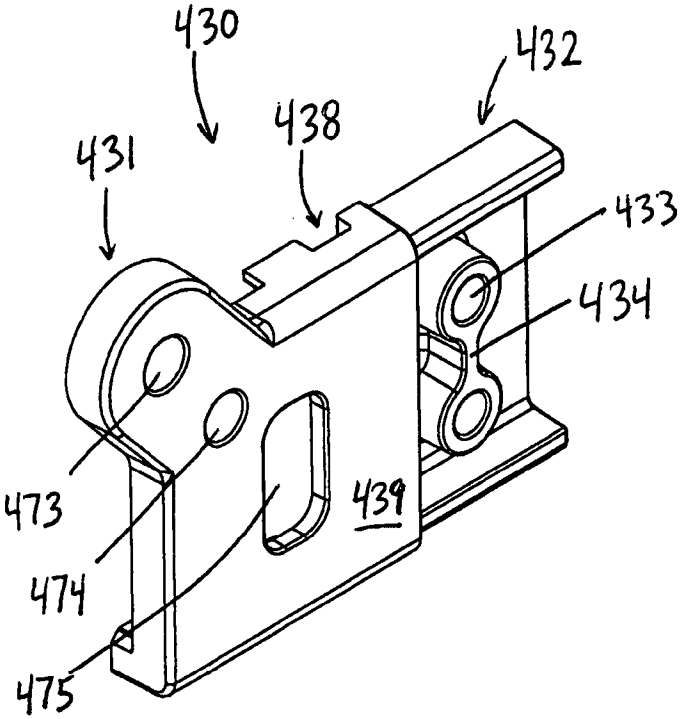
Figure 9B:
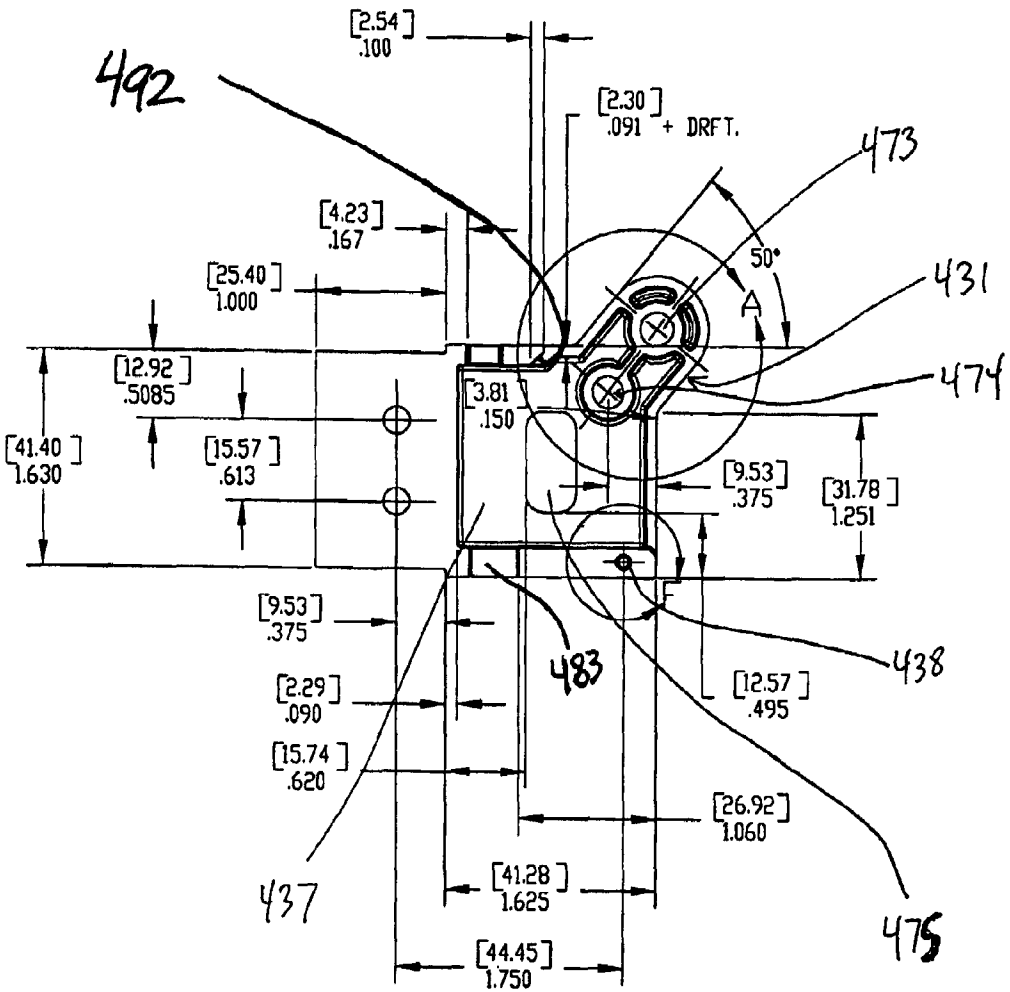
Figure 9D:
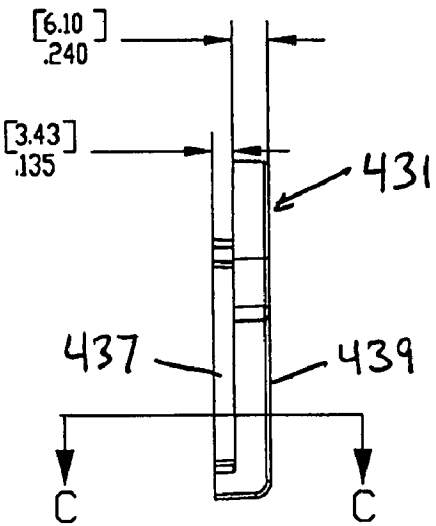
Figure 9C:
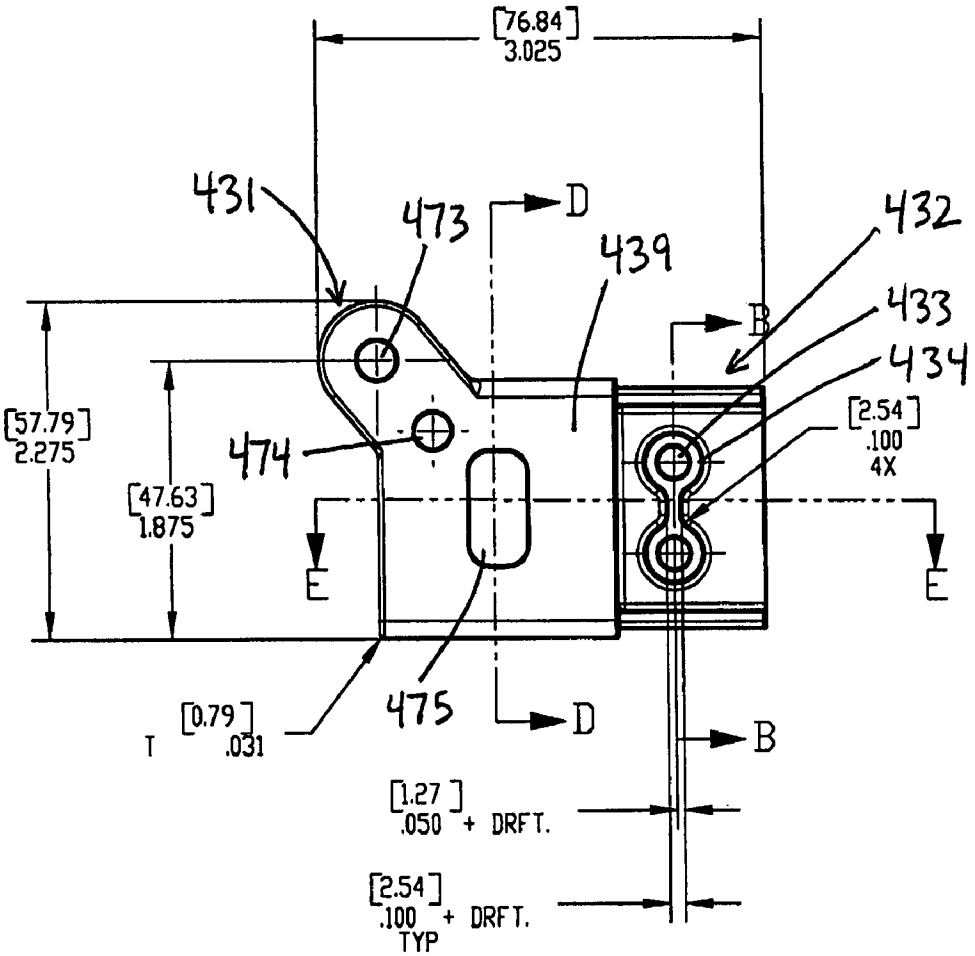
Figure 9G:
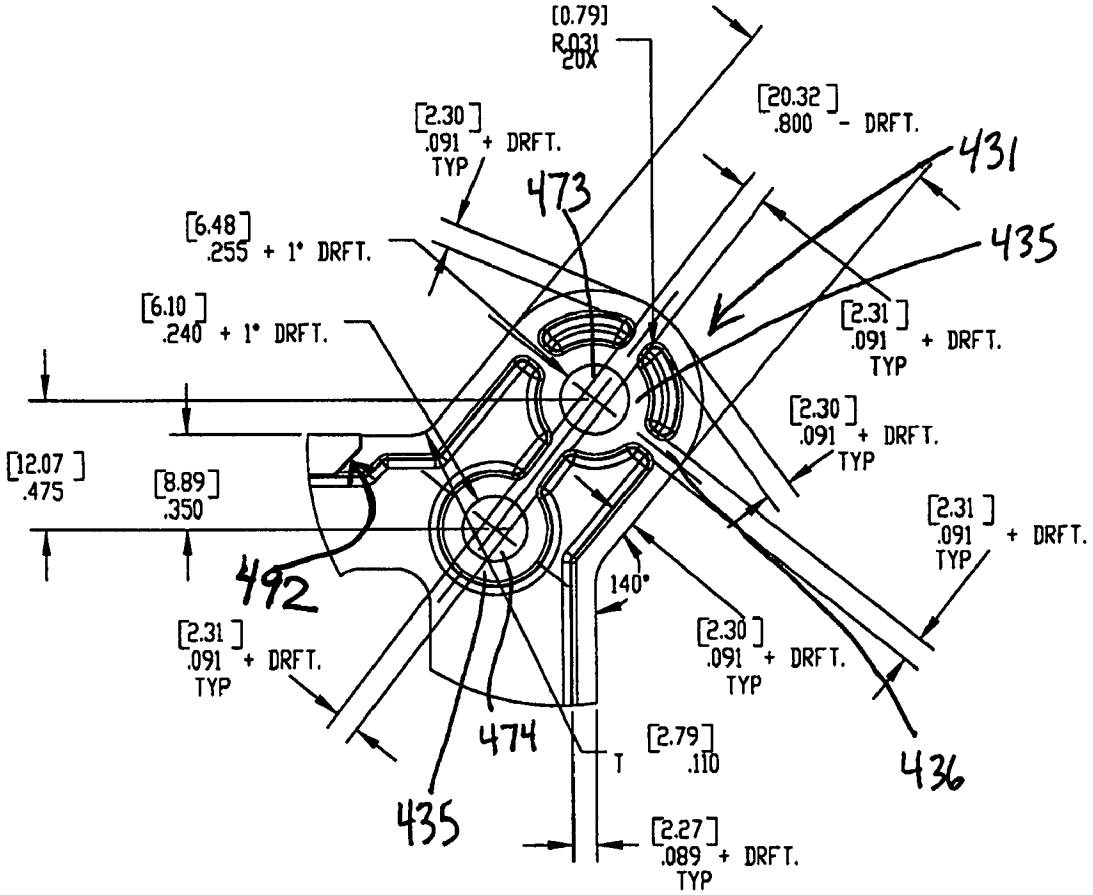
Figure 9F:
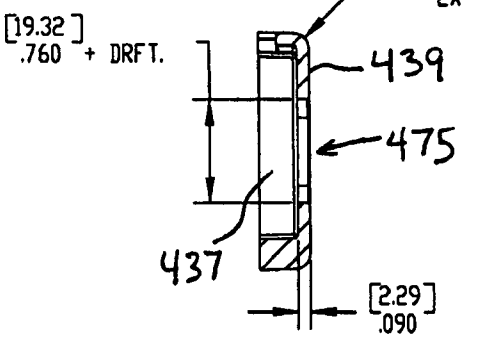
Figure 9H:
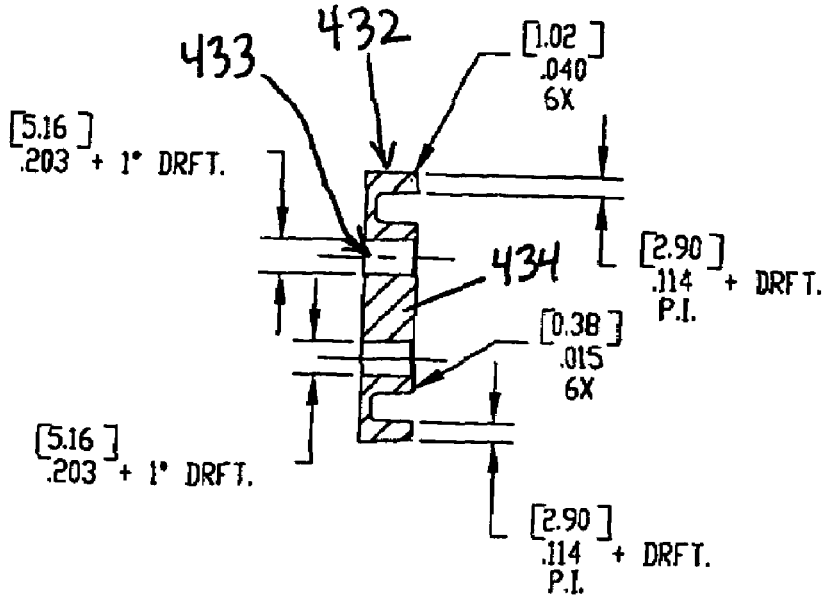
Figure 9I:
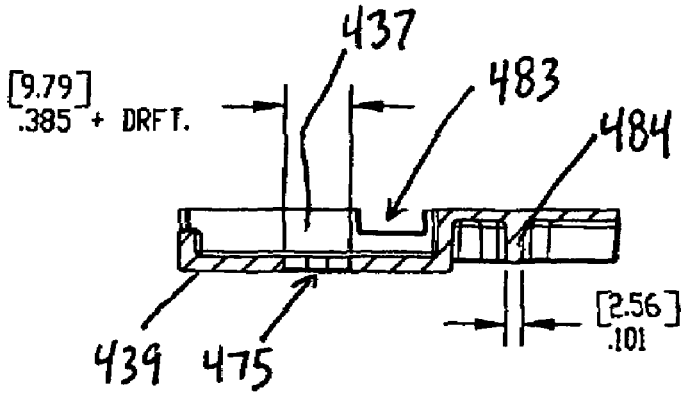
Figure 10D:
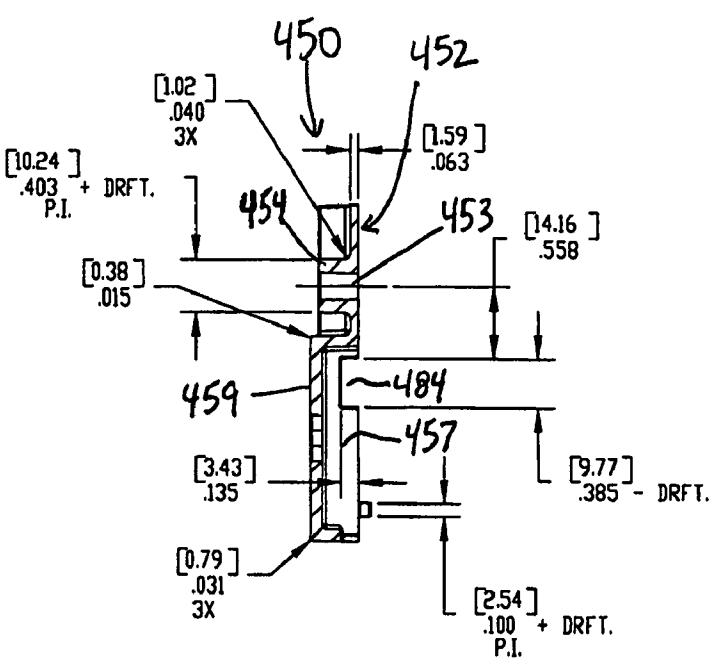
FIGS. 10(*a*)-(*d*) show views of a fourth hinge plate in accord with the present concepts, consisting of an isometric view, left and right side views, and a top-down cross-sectional view.
Figure 10A:
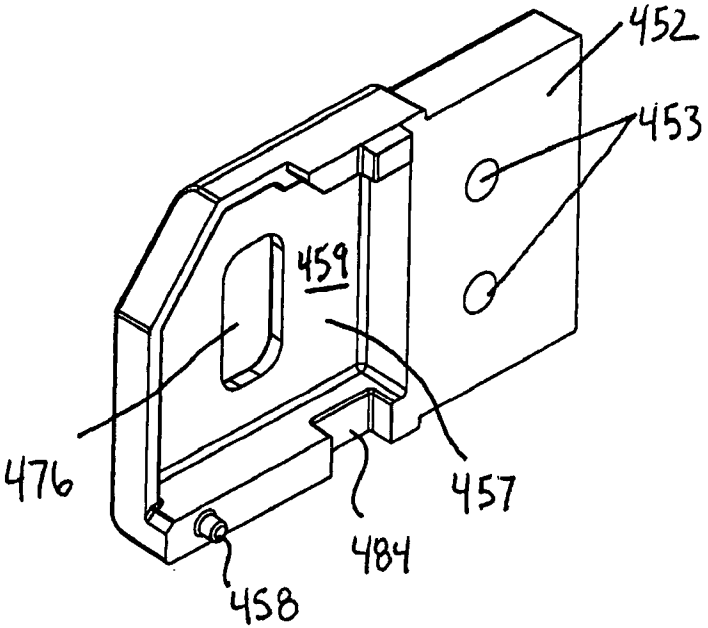
Figure 10B:
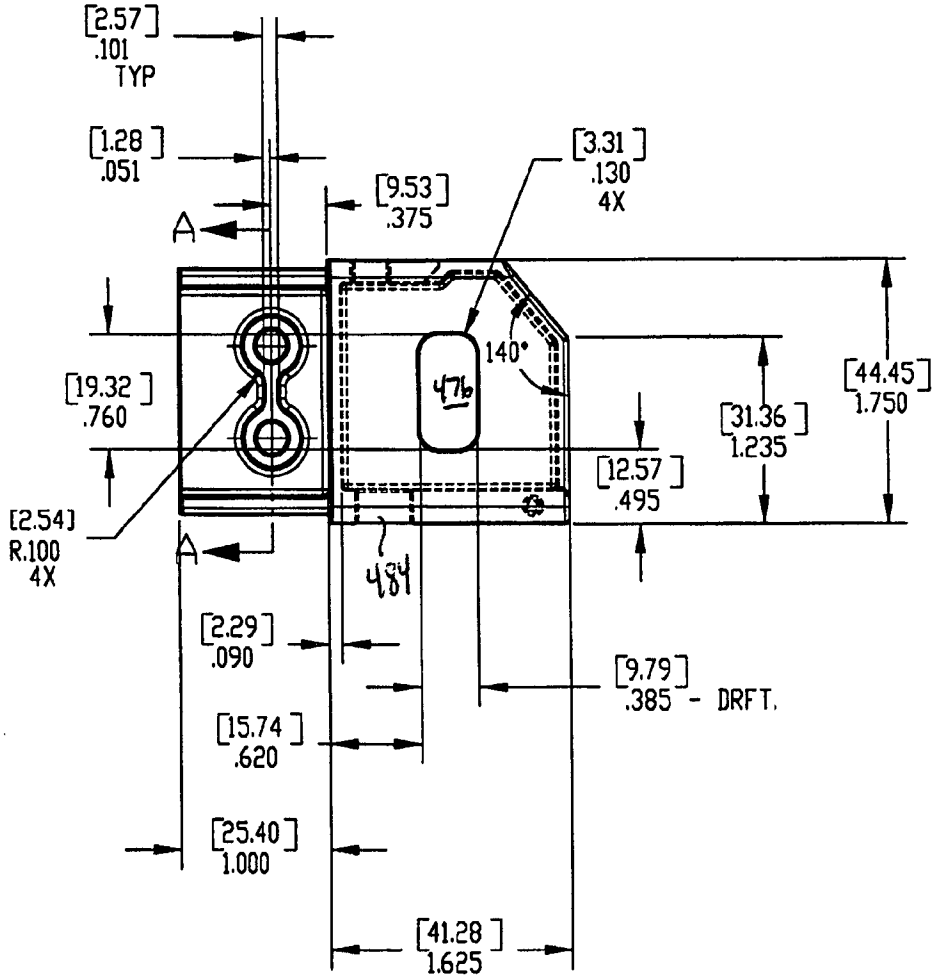
Figure 10C:
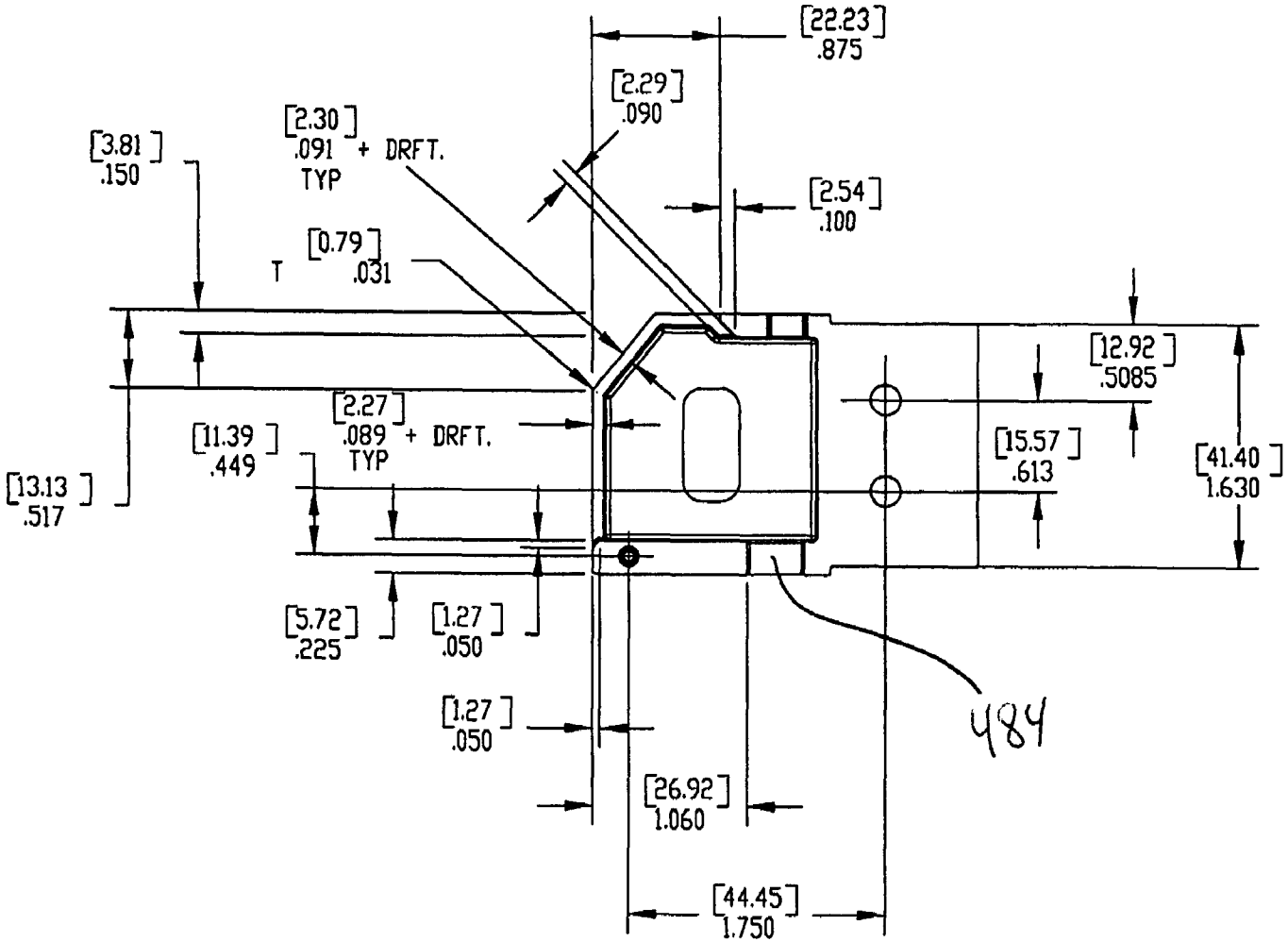

FIGS. 5(*a*)-(*b*) show left and right isometric views of one example of an assembled hinge 400 in accord with the present concepts. Hinge 400 comprises, in one aspect, an upper casing comprising two hinge plates (e.g., 430, 450) and a lower casing comprising two hinge plates (e.g., 420, 440), which may be made from Zinc Zamac 3, such as by a conventional casting process (e.g., sand casting, die casting, pressure casting, etc.). Other conventional metals or alloys (e.g., aluminum or aluminum alloys) or materials (e.g., composite materials, fiber reinforced plastics, etc.) may also be used in combination with conventional forming processes to form a hinge in accord with the present concepts. Hinge plates 420 and 430 are configured with complimentary shapes along a common boundary, as are hinge plates 440 and 450, such as shown. Hinge plates 420-450 attach to opposing sides of a joint provided at selected portions of ladder rails 105, 106.

FIGS. 5(*a*)-(*b*) show a hinge latch 460 provided between paired hinge plates 420, 430 and 440, 450. Although the hinge 400 is shown to include paired hinge plates 420, 430 and 440, 450, the hinge could also comprise a unitary upper casing or hinge plate and/or a unitary lower casing or hinge plate formed through a suitable conventional forming process (e.g., casting) and could comprise a greater number of hinge plates to form the respective upper and lower hinge sections. Hinge latch 460 is supported by hinge shaft 410 provided between hinge plates 420 and 440. Hinge shaft 410 may be configured for rotation with the hinge plates (e.g., 420, 430, 440, 450) being fixed relative thereto or the hinge shaft may be fixed with the hinge plates being rotatable relative thereto. A grip 407, a knob in the illustrated example, is provided to permit, as described more fully below, unlocking of hinge 400. Grip 407 may be formed, for example, from 1010 CRS (carbon steel). In one aspect, grip 407 is configured to have an overall outer diameter of about 22.2 mm, an overall length of about 29.8 mm, a shaft 408 diameter of about 6.3 mm, and a threaded portion (e.g., about 6.4 mm deep) to facilitate connection within first opening 463, such as by a force-fit connection or a threaded connection. The opposite end of shaft 408, which falls within the broad category of a biasing member and is also referred to herein generally as a first biasing member, is cantilevered and is adapted to translate within a slot 475 provided in hinge plate 430 to thereby permit upward translation of the hinge latch 460 relative to hinge shaft 410. Alternative grip or lever configurations wherein the grip may be used to bias the hinge latch 460 in a desired direction (e.g., an unlocking direction) are also within the scope of the concepts expressed herein.

FIG. 6(*a*) is an isometric view of a hinge latch 460 in accord with the present concepts showing generally, a first locking portion 461, a second locking portion 462, a first opening 463, a second opening 464 forming a lock recess, and elongated slot 465 comprising a protruding member or boss 466, details of which are further provided in the examples shown in FIGS. 6(*b*)-(*f*) and which are apparent in view of the additional disclosure herein. FIGS. 6(*b*)-(*c*) respectively depict a side view and a cross-sectional view of hinge latch 460. FIG. 6(*d*) shows a detailed view of aspects of hinge latch 460 including openings 463, 464. FIG. 6(*e*) shows a portion of elongated slot 465. FIG. 6(*f*) is a bottom view of hinge latch 460.

Figure 13A:
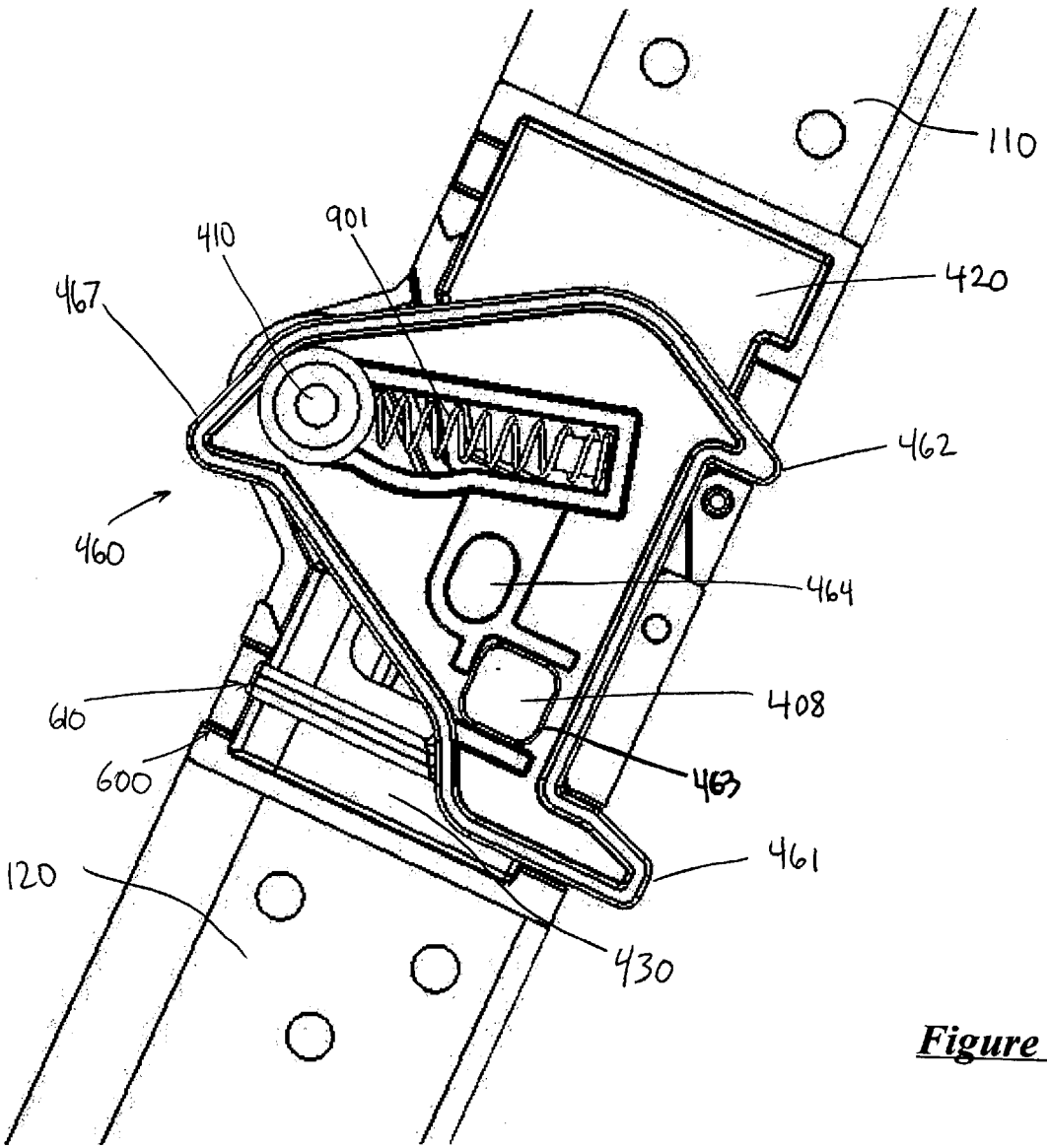
FIGS. 13(*a*)-(*b*) show views of a closed hinge with a locked hinge latch, in accord with the second example of the present concepts, from a point of view inside the ladder rail looking out and from a point of view outside the ladder rail looking in, respectively, with some hinge plates removed for clarity.
Figure 13B:
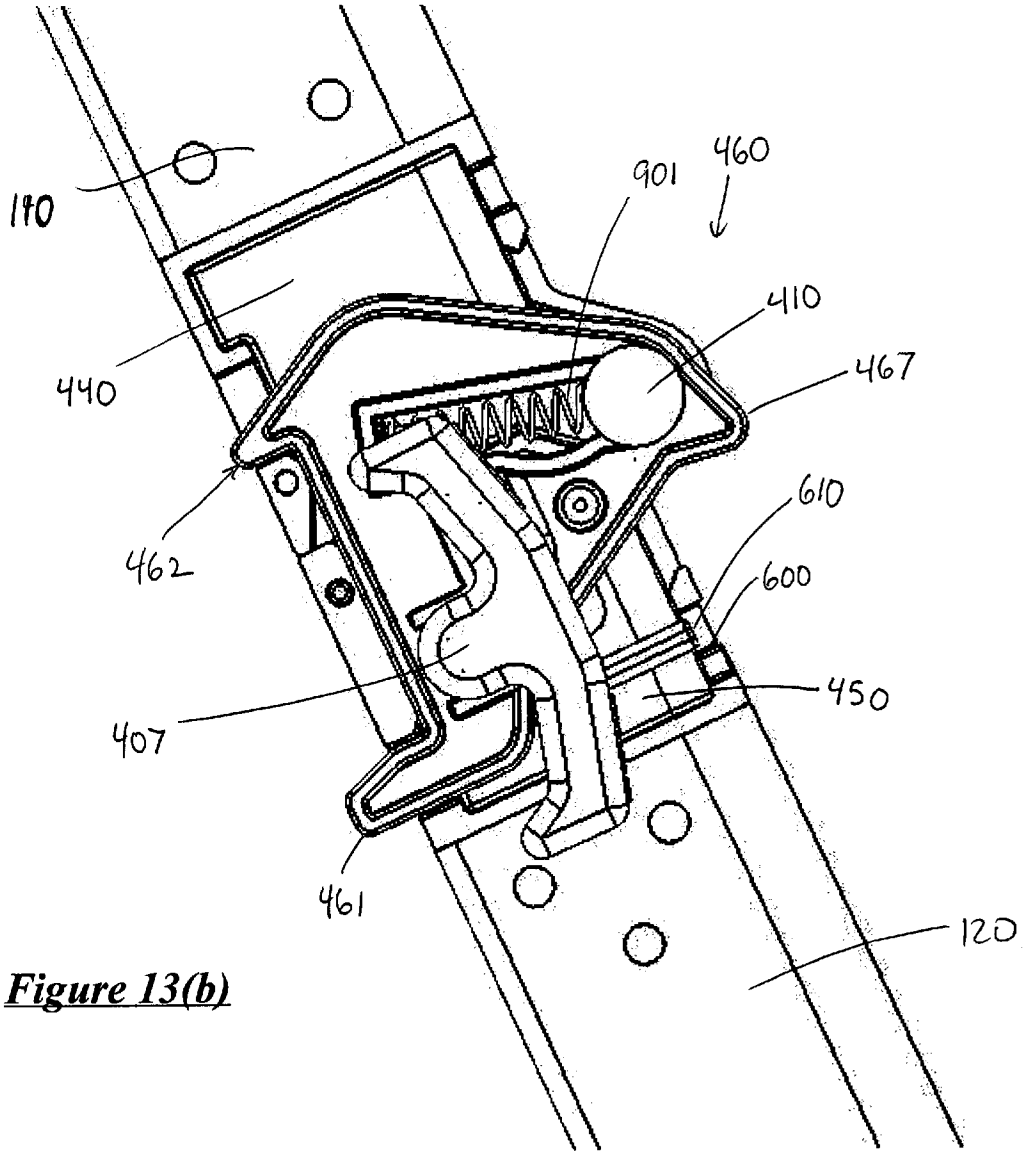

In one aspect, hinge latch 460 may be formed from a powder metal, such as 17-4 PH or MPIF (Metal Powder Industries Federation) F-0005-20 (low carbon steel (0.3-0.6% C)), although other grades, metals, alloys, or materials may also be used. A first biasing member 901, such as a compression spring is connected at one end to the boss 466 and is disposed at another end to abut against shaft 410, such as shown in FIGS. 13(*a*)-16(*b*). In one aspect, such biasing member 901 could comprise a wire spring with squared ends having a free length of 31.75 mm, a diameter of 6.10 mm, and a solid height of about 7.20 mm, with a spring rating of about 0.059 kg/mm.

As installed, hinge latch 460 is placed in the orientation shown, for example, in FIGS. 5(*a*)-(*b*), with the angled portion 467 protruding outwardly from the hinge 400. Shaft 410 sequentially passes through hole 471 of hinge plate 420, hole 473 of hinge plate 430, a front portion of elongated slot 465 in the vicinity of angled portion 467, and hole 472 of hinge plate 440. As shown in FIGS. 13(*a*)-16(*b*), shaft 410 is free to translate within elongated slot 465, shown in FIG. 6(*a*), as the hinge is unlocked and locked. Elongated slot 465 is provided with an indentation 495 along a side thereof. This indentation 495 is provided in the illustrated aspect of the invention to advantageously prevent binding between latch shaft 410 and a side of the elongated slot 465 arising from the differences in lines of travel between the latch shaft 410, which translates in one direction, and the slot which is provided at an angle to said one direction.

FIG. 7(*a*) shows an isometric view of hinge plate 420, generally illustrating a hinge latch support portion 421, a ladder rail connecting portion 422, and a main body portion 429. FIGS. 7(*b*)-7(*c*) show left and right side views of hinge plate 420, whereas FIGS. 7(*d*)-7(*e*) show front and rear views thereof (omitting ladder rail connecting portion 422 for clarity). FIG. 7(*f*) shows a top-down cross-sectional view of hinge plate 420 taken along line C-C in FIG. 7(*d*). FIG. 7(*g*) shows a detailed view of the hinge latch support portion 421. FIG. 7(*h*) shows a cross-sectional view of ladder rail connecting portion 422 taken along line B-B in FIG. 7(*b*).

As shown in FIGS. 7(*b*), 7(*c*) and 7(*g*), hinge latch support portion 421 is provided with a boss 425, preferably reinforced with reinforcing ribs 426, as shown. Through-hole 471 is provided within boss 425 to rotatably support an end of shaft 410.

As shown in FIGS. 7(*b*), 7(*c*) and 7(*h*), ladder rail connecting portion 422 has through-holes 423 (or threaded recess) provided within a boss section 424 at a location coaxial to holes (not shown) provided in a corresponding ladder rail 105, 106 section. In cross-section, shown in FIG. 7(*h*), the ladder rail connecting portion 422 forms half of an I-beam shape. In combination with a corresponding ladder rail connecting portion (e.g., 442) of an opposing hinge plate (e.g., 440), an I-beam shape with co-axial through-holes (e.g., 423, 443) is realized. The combined I-beam shaped ladder rail connecting portion (e.g., 422, 442) is inserted into an opening in a ladder rail and the ladder rail connecting portions (e.g., 422, 442) are connected to the ladder rail 105, 106 by conventional attachment means, such as rivets or screws. The location, spacing and diameter of the through holes, as well as the overall dimensions of the ladder rail connecting portion 422, may be freely varied to correspond with any configuration of ladder rail.

As shown in FIGS. 7(*a*) and 7(*c*), for example, hinge plate 420 main body portion 429 includes an opening 427 which forms, in combination with a corresponding opening (e.g., 447) in an opposing hinge plate (e.g., 440), a cavity within which the hinge latch 460 is permitted to operate. Hinge plate 420 main body portion 429 also includes a cutout 481, as shown in FIGS. 7(*a*), (*c*) and (*f*) which forms, in combination with a corresponding opening (e.g., 482) in an opposing hinge plate (e.g., 440), a lock opening within which a locking portion 461 of the hinge latch 460 is permitted to operate. Main body portion 429 may include male/female connector portions 428 to facilitate alignment and connection to an opposing hinge plate.

FIG. 8(*a*) shows an isometric view of hinge plate 440 including a hinge latch support portion 441, a ladder rail connecting portion 442, and a main body portion 449. FIGS. 8(*b*)-8(*d*) show left and right side views and a top view of hinge plate 440. FIG. 8(*e*) shows a front to back cross-sectional view of hinge plate 440 taken along line B-B in FIG. 8(*d*). FIG. 8(*f*) shows a detailed view of the hinge latch support portion 441 and FIG. 8(*g*) shows a cross-sectional view of ladder rail connecting portion 442 taken along line D-D in FIG. 8(*c*).

As shown in FIGS. 8(*b*), 8(*c*) and 8(*f*), hinge latch support portion 441 is provided with a boss 445, preferably reinforced with reinforcing ribs 446. Through-hole 472 is provided within boss 445 to rotatably support an end of shaft 410.

As shown in FIGS. 8(*b*), 8(*c*) and 8(*g*), ladder rail connecting portion 442 has through-holes 443 (or threaded recess) provided within a boss section 444 at a location coaxial to holes (not shown) provided in a corresponding ladder rail 105, 106 section. In cross-section, shown in FIG. 8(*h*), the ladder rail connecting portion 442 forms half of an I-beam shape. In combination with a corresponding ladder rail connecting portion (e.g., 422) of an opposing hinge plate (e.g., 420), an I-beam shape with co-axial through-holes (e.g., 423, 443) is realized. As noted above, the combined I-beam shaped ladder rail connecting portion (e.g., 422, 442) is inserted into an opening in a ladder rail and the ladder rail connecting portions (e.g., 422, 442) are connected to the ladder rail 105, 106 by conventional attachment means, such as rivets or screws. As with the opposing hinge plate 420, the location, spacing and diameter of the through holes, as well as the overall dimensions of the ladder rail connecting portion 442, may be freely varied to correspond with any configuration of ladder rail.

Hinge plate 440 main body portion 449 includes an opening 447 which forms, in combination with a corresponding opening (e.g., 427) in an opposing hinge plate (e.g., 420), a cavity within which the hinge latch 460 is permitted to operate. Hinge plate 440 main body portion 449 also includes a cutout 482, as shown in FIGS. 8(*a*), (*b*) and (*e*) which forms, in combination with a corresponding opening (e.g., 481) in an opposing hinge plate (e.g., 420), a cavity within which a locking portion 461 of the hinge latch 460 is permitted to operate. Main body portion 449 optionally includes male/female connector portions 448 to facilitate alignment and connection to an opposing hinge plate (e.g., 420).

FIG. 9(*a*) shows an isometric view of hinge plate 430, generally illustrating a hinge latch support portion 431, a ladder rail connecting portion 432, and a main body portion 439. FIGS. 9(*b*)-9(*c*) show left and right side views of hinge plate 430, whereas FIGS. 9(*d*) shows a front view thereof. FIG. 9(*e*) shows a top-down cross-sectional view of hinge plate 430 taken along line C-C in FIG. 7(*d*). FIG. 9(*f*) shows a cross-sectional view of hinge plate 430 taken along line D-D in FIG. 9(*c*). FIG. 9(*g*) shows a detailed view of the hinge latch support portion 431. FIG. 9(*h*) shows a cross-sectional view of ladder rail connecting portion 432 taken along line B-B in FIG. 9(*c*). FIG. 9(*i*) shows a cross-sectional view of hinge plate 430 taken along line E-E in FIG. 7(*c*).

As shown in FIGS. 9(*b*), 9(*c*) and 9(*g*), hinge latch support portion 431 is provided with a boss 435, preferably reinforced with reinforcing ribs 436, defining two through-holes 473, 474. Through-hole 473 is adapted to support shaft 410. Through-hole 474 is adapted to support a spring plunger 902 (see FIG. 32(*a*), 33(*a*)). In one aspect, the spring plunger 902 has an outer diameter of 6.10 mm and houses a ball protruding therefrom by 1.52 mm from a flanged portion having a diameter of 6.60 mm disposed to prevent outward displacement of the spring plunger. The ball itself is spring-loaded and provides an initial force of about 0.56 kg. and a final force of about 1.18 kg. Hinge latch support portion 431 of hinge plate 430 is disposed adjacent and inside of the hinge latch support portion 421 of hinge plate 420 to align through-holes 473 and 471.

As shown in FIGS. 9(*b*), 9(*c*) and 9(*h*), ladder rail connecting portion 432 has through-holes 433 (or threaded recess) provided within a boss section 434 at a location coaxial to holes (not shown) provided in a corresponding ladder rail 105, 106 section. In cross-section, shown in FIG. 9(*h*), the ladder rail connecting portion 432 forms half of an I-beam shape. In combination with a corresponding ladder rail connecting portion (e.g., 452) of an opposing hinge plate (e.g., 450), an I-beam shape with co-axial through-holes (e.g., 433, 453) is realized. The combined I-beam shaped ladder rail connecting portion (e.g., 432, 452) is inserted into an opening in a ladder rail and the ladder rail connecting portions (e.g., 422, 442) are connected to the ladder rail 105, 106 by conventional attachment means, such as rivets or screws. The location, spacing and diameter of the through holes, as well as the overall dimensions of the ladder rail connecting portion 432, may be freely varied to correspond with any configuration of ladder rail.

As shown in FIGS. 9(*b*), 9(*d*) and 9(*e*), for example, hinge plate 430 main body portion 439 includes an opening 437 which forms, in combination with a corresponding opening (e.g., 457) in an opposing hinge plate (e.g., 450), a cavity within which the hinge latch 460 is permitted to operate. Hinge plate 430 main body portion 439 also includes a cutout 483, as shown in FIGS. 9(*a*), (*b*) and (*i*) which forms, in combination with a corresponding opening (e.g., 484) in an opposing hinge plate (e.g., 450), a cavity within which a bottom locking portion 462 of the hinge latch 460 is permitted to operate. Main body portion 439 optionally includes male/female connector portions 438 to facilitate alignment and connection to an opposing hinge plate.

FIGS. 9(*a*)-(*c*) and 9(*e*)-(*f*), opening or slot 475 is provided through main body portion 439 of hinge plate 430. The diameter or width of the opening 475 is greater than an outer diameter of the knob shaft 408 to permit translation of the shaft 408 within the slot, as generally depicted in FIG. 6.

FIG. 10(*a*) shows an isometric view of hinge plate 450, generally illustrating a ladder rail connecting portion 452 and a main body portion 459. FIGS. 10(*b*)-10(*c*) show left and right side views of hinge plate 450. FIG. 10(*d*) shows a top-down cross-sectional view of hinge plate 450.

As shown in FIGS. 10(*b*), (*c*) and (*d*), ladder rail connecting portion 452 has through-holes 453 (or threaded recess) provided within a boss section 454 at a location coaxial to holes (not shown) provided in a corresponding ladder rail 105, 106 section. Similar to the above described ladder rail connecting portions, the ladder rail connecting portion 452 forms, in combination with a corresponding ladder rail connecting portion (e.g., 432) of an opposing hinge plate (e.g., 430), an I-beam shape with co-axial through-holes (e.g., 433, 453). The combined I-beam shaped ladder rail connecting portion (e.g., 432, 452) is inserted into an opening in a ladder rail and the ladder rail connecting portions (e.g., 432, 452) are connected to the ladder rail 105, 106 by conventional attachment means, such as rivets or screws. The location, spacing and diameter of the through holes, as well as the overall dimensions of the ladder rail connecting portion 452, may be freely varied to correspond with any configuration of ladder rail.

As shown in FIGS. 10(*a*)-10(*c*), for example, hinge plate 450 main body portion 459 includes an opening 457 which forms, in combination with a corresponding opening (e.g., 437) in an opposing hinge plate (e.g., 430), a cavity within which the hinge latch 460 is permitted to operate. Hinge plate 450 main body portion 459 also includes a cutout 484, as shown in FIGS. 10(*a*)-(*d*) which forms, in combination with a corresponding opening (e.g., 483) in an opposing hinge plate (e.g., 430), a cavity within which a bottom locking portion 462 of the hinge latch 460 is permitted to operate. Main body portion 459 optionally includes male/female connector portions 458 to facilitate alignment and connection to an opposing hinge plate. Main body portion 459 also includes an angled or chamfered section 456 configured to correspond in shape to a bottom surface of hinge latch support portion 441.

FIGS. 10(*a*)-(*c*) show opening 476 provided through main body portion 459 of hinge plate 450. In one aspect, the shape and size of opening 476 is substantially the same as that of opening 475 in hinge plate 430 and is able to perform the same function thereof. In other words, it is desired to place the latch or locking mechanism such that the knob 407 is disposed toward an outside of the ladder rail. Proving both opening 476 in hinge plate 450 and opening 475 in hinge plate 430 enables a single manufactured ladder rail to be used for both the left and the right ladder rails while retaining knob 407 disposed toward an outside of each of the left and right ladder rail. Thus, provision of opening 476 economizes manufacture and reduces cost, but is not itself a necessary feature of the invention and may be omitted if the left and right ladder rails are separately configured.

Figure 11A:
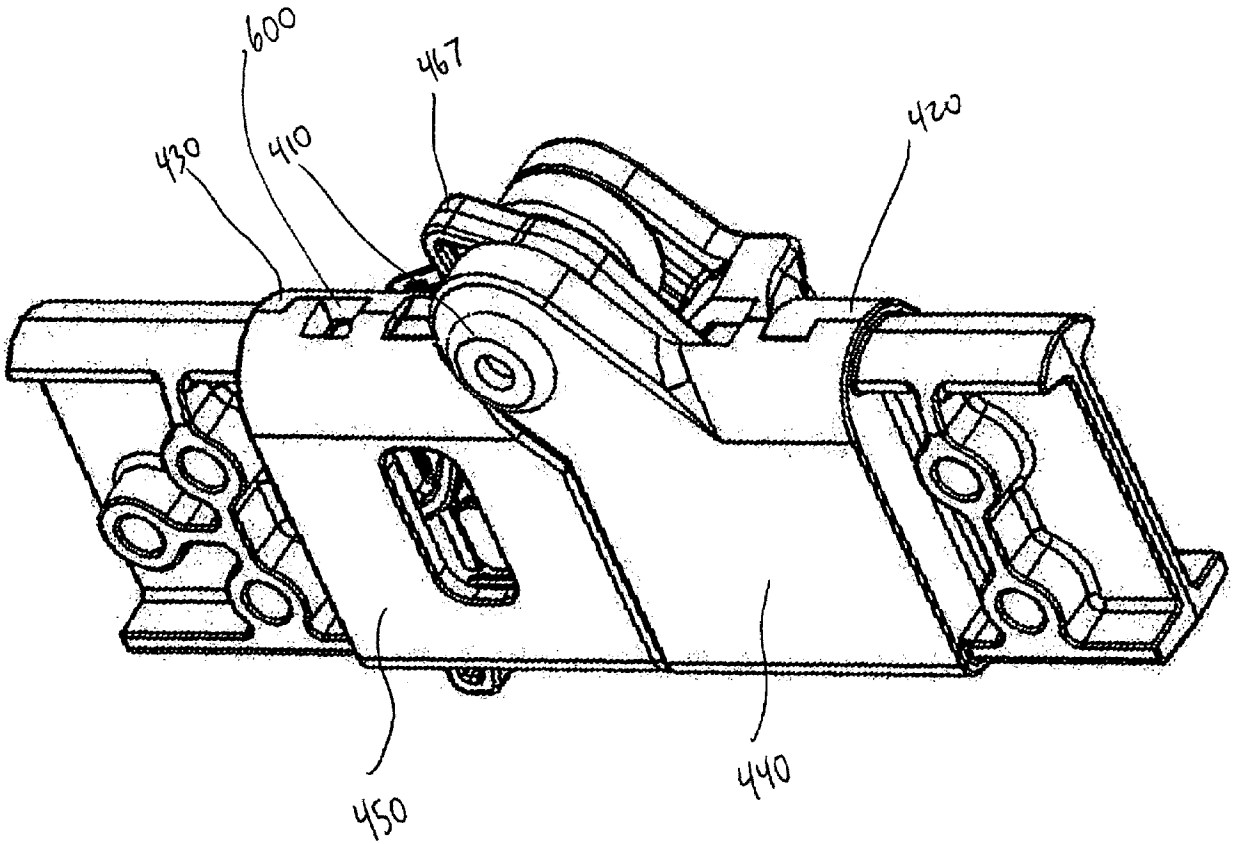
FIGS. 11(*a*)-(*b*) show left and right isometric views an assembled hinge in accord with a second example of the present concepts.
Figure 11B:
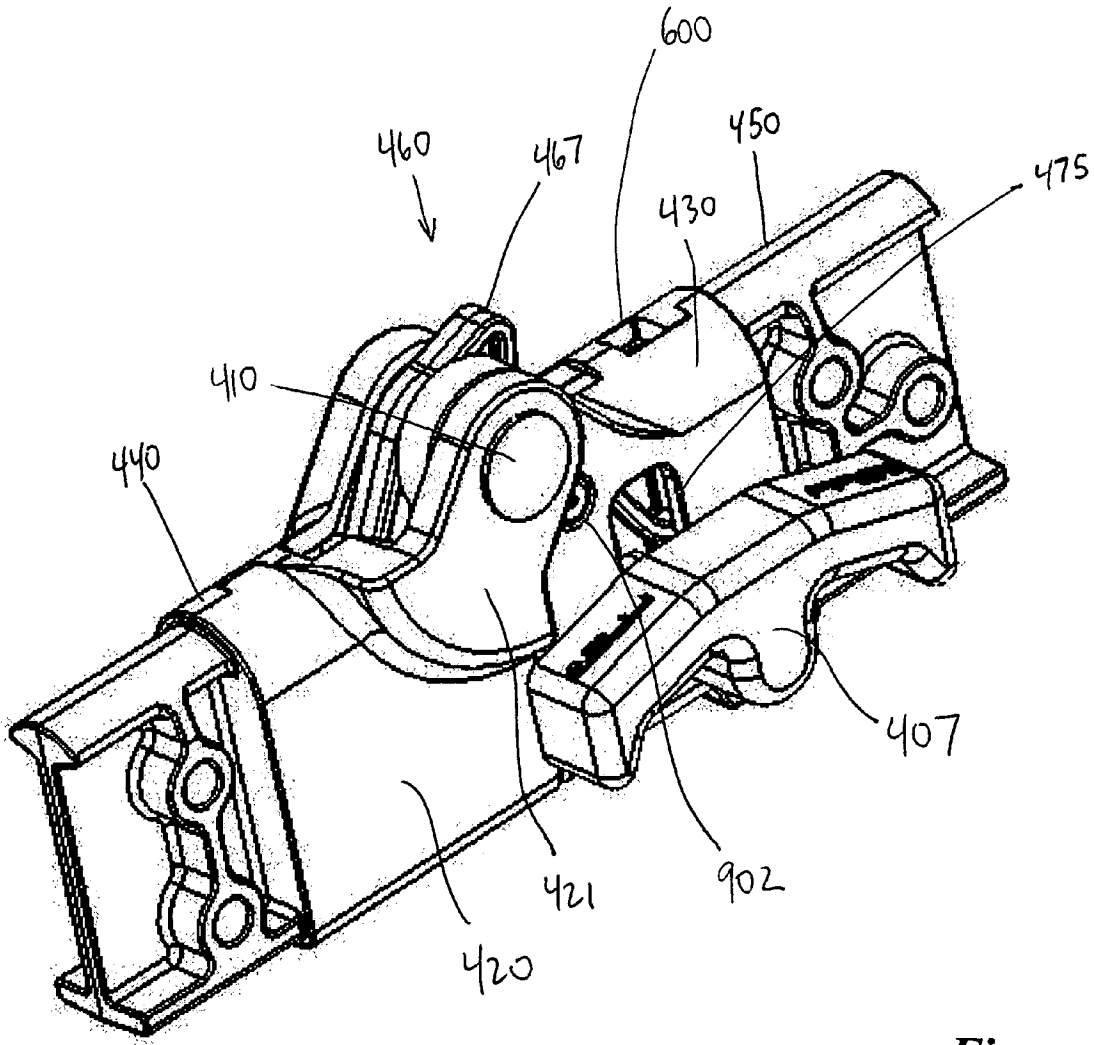
Figure 12:
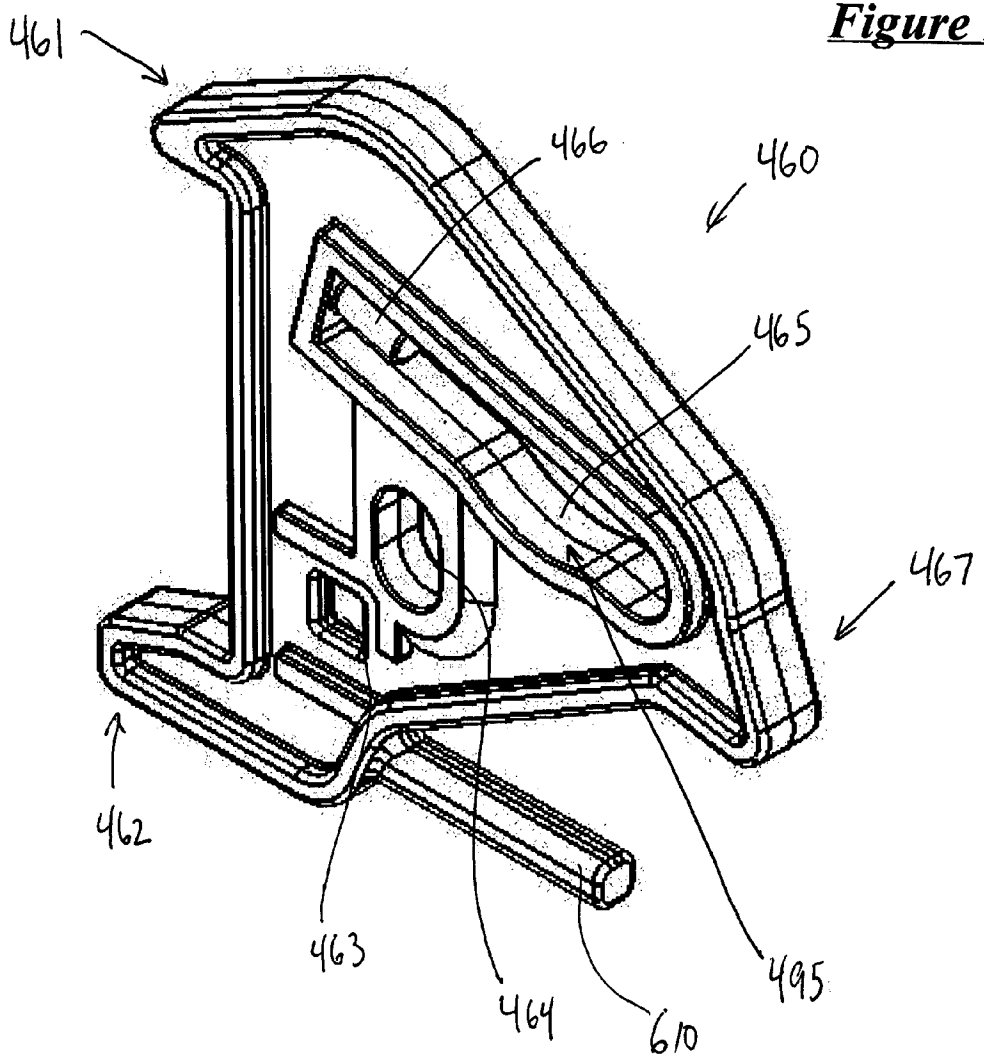
FIG. 12 shows an isometric view of a hinge latch in accord with the second example of the present concepts.

FIGS. 11(*a*)-(*b*) show left and right isometric views an assembled hinge in accord with a second example of the present concepts. Similar parts are similarly numbered and additional description thereof is omitted for brevity. In this example, an opening 600 is defined at the top of mating hinge plates 430, 450. Opening 600 is configured to receive a projecting member 610 projecting from the hinge latch 460, which is shown in FIG. 12. When the hinge 400 is in a closed and locked state, the projecting member 610 projects through opening 600 to provide a visual indication of such closed and locked state on the side of the ladder having opening 600. In the depicted example, the projecting member 610 ladder is intended face toward the user of the ladder to provide a clear visual and/or tactile indicator that the hinge is locked. It is noted that the projecting portions of the hinge latch 460 (e.g., locking portion 461) could also be used as a sole visual indication of such closed and locked state in accord with the first example.

The operation of the second example of the hinge 400 depicted in FIGS. 11(*a*)-(*b*) will now be described with respect to FIGS. 13(*a*)-16(*b*). The operation of the first example of the hinge 400 provided in FIGS. 5(*a*)-10(*c*) is similar to that shown in FIGS. 11(*a*)-(*b*).

FIG. 13(*a*) shows a view of a closed hinge 400 from a point of view inside the ladder rail (e.g., 105) looking out, with hinge plates 440, 450 removed for clarity. FIG. 13(*b*) shows another view of a closed hinge 400 from a point of view outside the ladder rail (e.g., 105) looking in, with hinge plates 420, 430 removed for clarity. As shown in FIG. 13(*a*), the first bottom locking portion 461 and second bottom locking portion 462 of hinge latch 460 are engaged with the corresponding cutouts 481, 483 in hinge plates 420, 430, respectively.

FIG. 13(*b*) shows a view of a closed hinge 400 from a point of view outside the ladder rail (e.g., 105) looking in, with hinge plates 420, 430 removed for clarity. FIG. 13(*b*) shows the first bottom locking portion 461 and second bottom locking portion 462 of hinge latch 460 engaged with the cutouts 482, 484 in hinge plates 440, 450, respectively. In both views, elongated slot 465 houses a compression spring 901 disposed between boss 466 and shaft 410. FIG. 13(*b*) also shows grip 407, a substantially E-shaped member connected, such as by a threaded shaft or force-fit, within first opening 463 (see, e.g., FIG. 6(*a*)) Grip 407 is adapted to translate within slot 475 provided in hinge plate 430 (see, e.g., FIG. 9(*a*)).

Figure 14A:
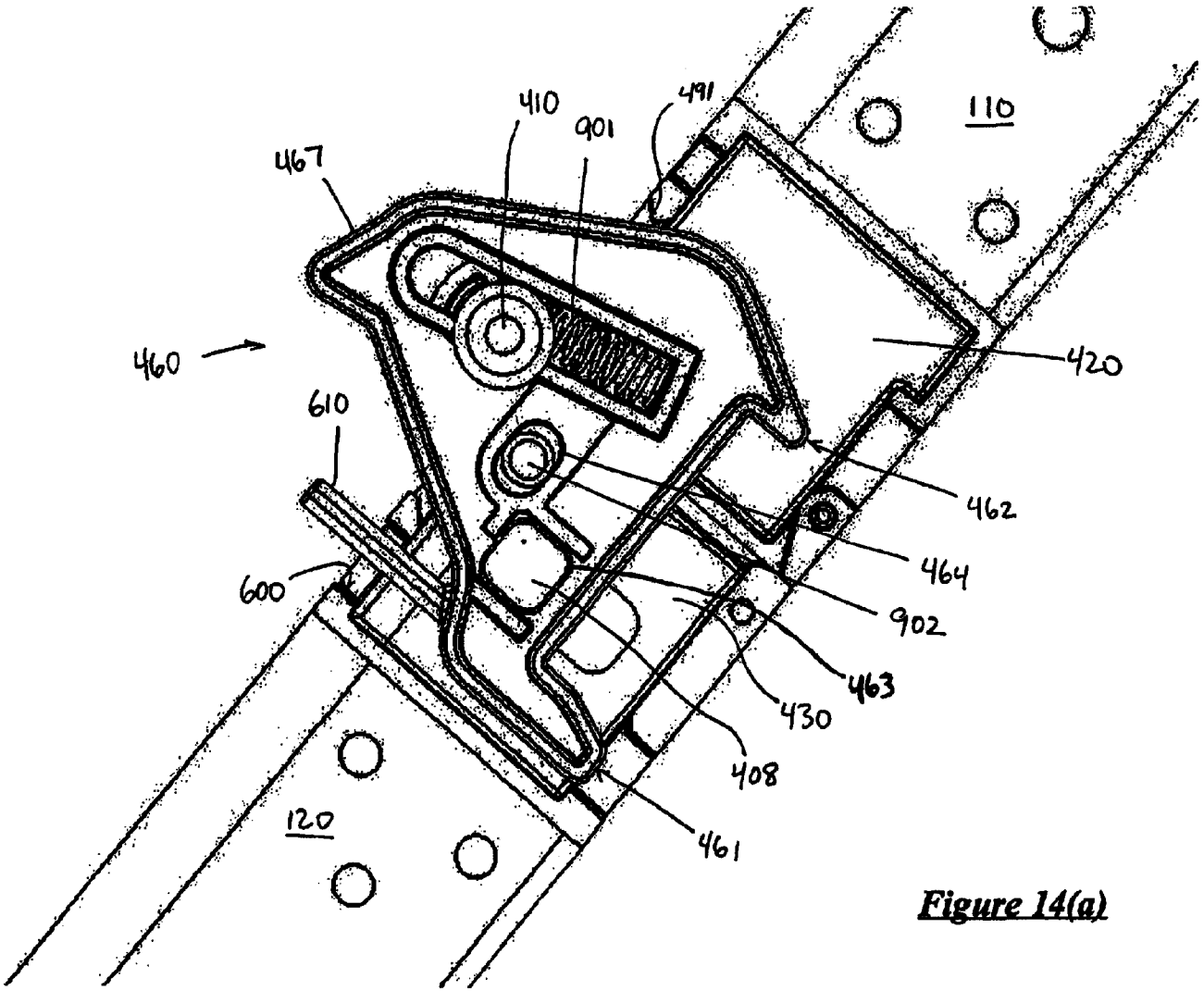
FIGS. 14(*a*)-(*b*) show views of a closed hinge with an unlocked hinge latch, in accord with the second example of the present concepts, from a point of view inside the ladder rail looking out and from a point of view outside the ladder rail looking in, respectively, with some hinge plates removed for clarity.
Figure 14B:
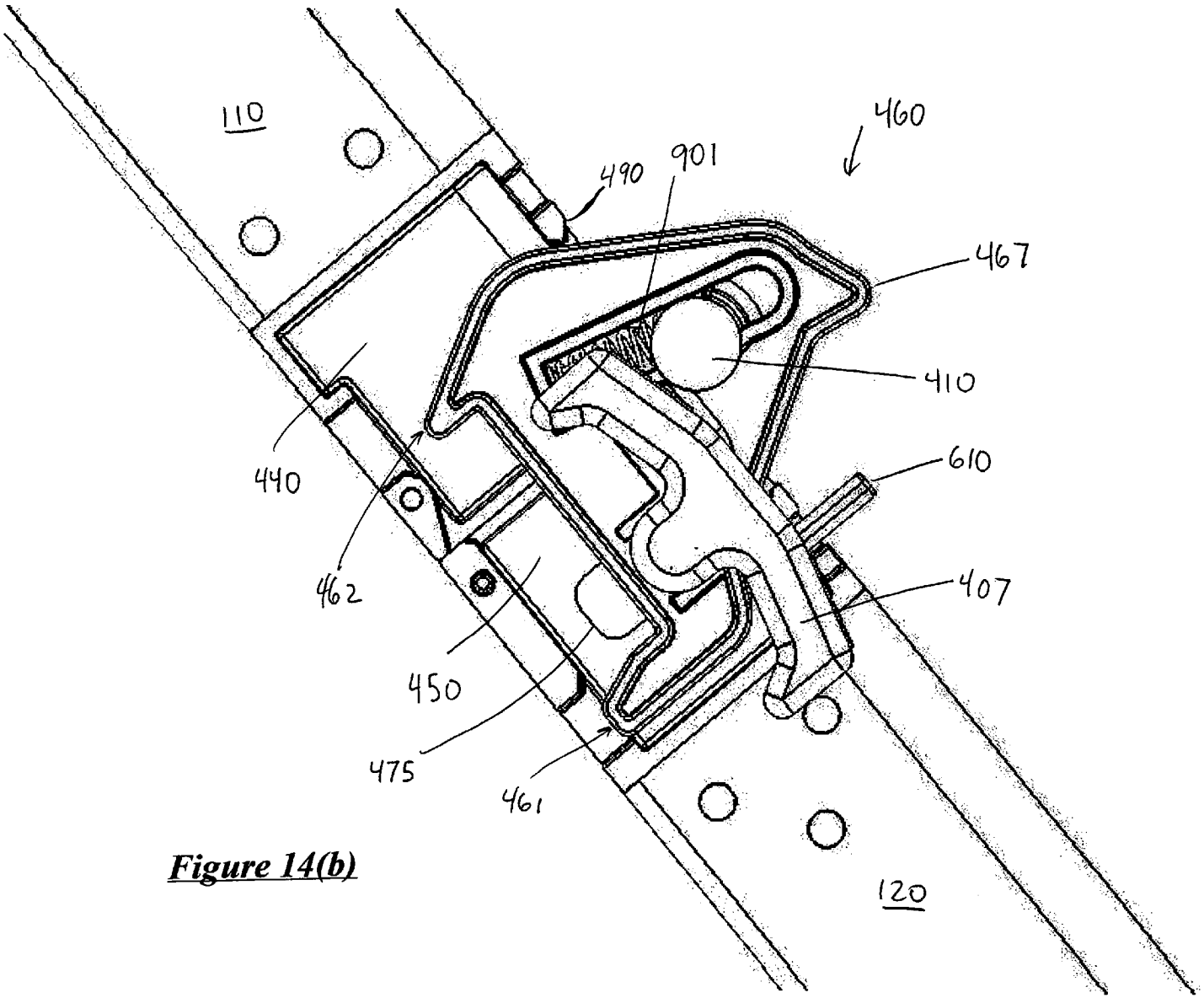

FIG. 14(*a*) shows a view of a closed hinge 400 with an unlocked hinge latch 460 from a point of view inside the ladder rail (e.g., 105) looking out, with hinge plates 440, 450 removed for clarity. The translation of grip 407 within slot 475 thereby permits upward and forward translation (from the side view of FIG. 14(*b*) which depicts the hinge 400 from outside of the ladder rail) of the hinge latch 460 relative to hinge shaft 410, as shown in FIGS. 14(*a*)-14(*b*). This translation progressively compresses the spring 901 housed within elongated slot 465 and moves hinge latch 460 lock recess 464 closer and closer to the ball of the spring plunger 902. As shown in FIG. 14(*a*), a spring plunger 902 housed within hinge plate 430 through-hole 474 (not shown) engages the hinge latch 460 lock recess 464. In this position, the spring-loaded plunger ball is biased into the lock recess 464 and prevents translational movement of the hinge latch 460 under the bias of the compressed spring 901.

In the hinge latch 460 locked open position shown in FIGS. 14(*a*)-14(*b*), relative rotational motion of a ladder upper section (e.g., 110) and a ladder middle section (e.g., 120) is permitted since the first bottom locking portion 461 is displaced from the opening formed by cutouts 481, 483 in hinge plate pair 450, 430 and the second bottom locking portion 462 is displaced from the opening formed by cutouts 482, 484 in hinge plate pair 440, 420.

As previously described, hinge plates 420, 430, and 440 each include a hole 471, 473, and 472, respectively, through which the hinge 400 shaft 410 is passed. Hinge latch 460 and hinge plates 420, 440 are configured to rotate about shaft 410 relative to hinge plates 430, 450, respectively, as shown in FIGS. 15(*a*)-(*b*) and 16(*a*)-(*b*).

Figure 15A:
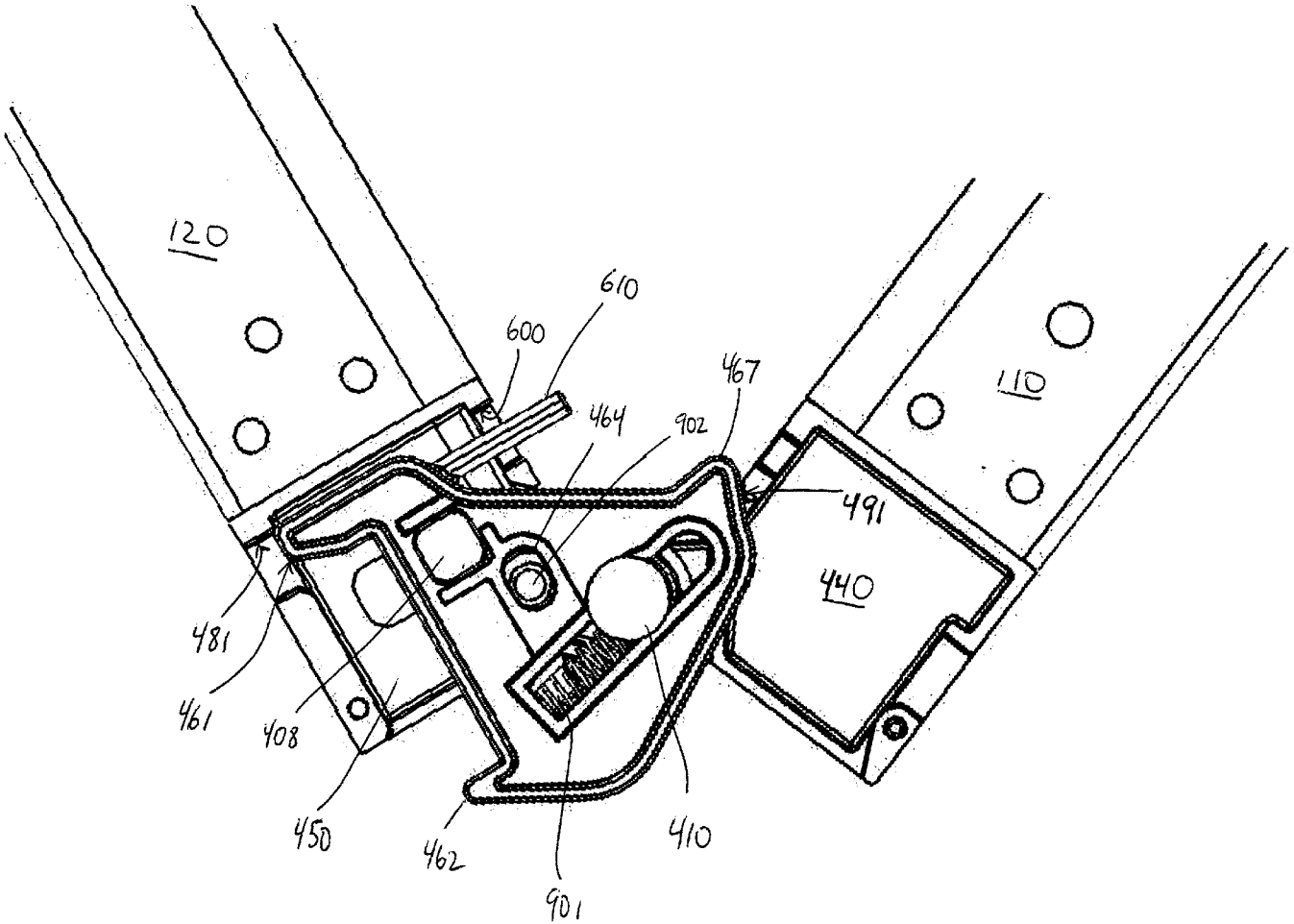
FIG. 15(*a*) shows a view of a opening hinge with an unlocked hinge latch, in accord with the second example of the present concepts, from a point of view outside of the right ladder rail looking in with some hinge plates and the knob removed for clarity.
Figure 15B:
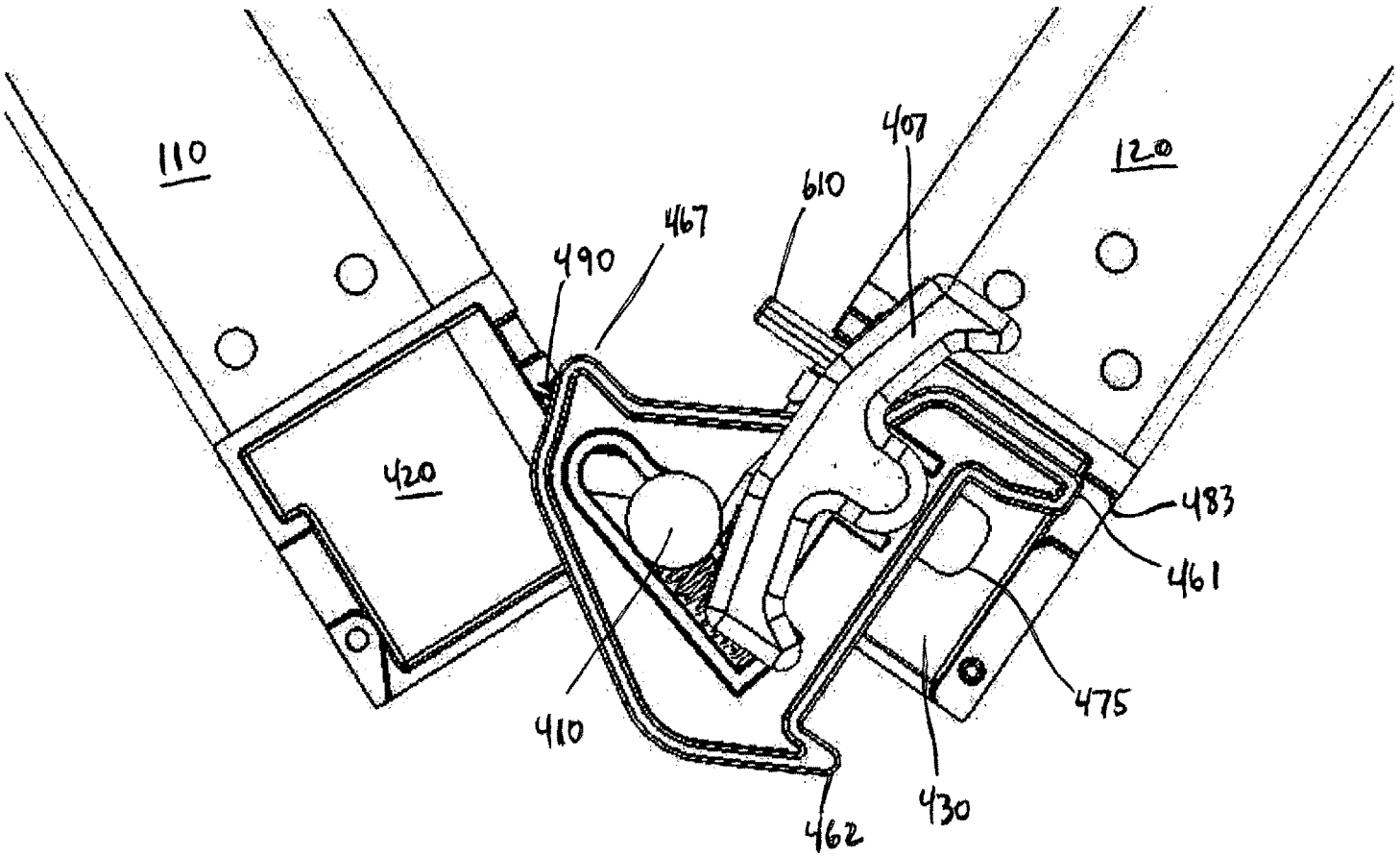

FIGS. 15(*a*) and 16(*b*) show views of a hinge 400 in varying states from a point of view outside of the right ladder rail 106 looking in toward the steps 150 of the ladder, wherein hinge plates 420, 430 were removed for clarity. FIGS. 15(*b*) and 16(*a*) show views of a hinge 400 in varying states from a point of view outside of the left ladder rail 105 looking in toward the steps 150, wherein hinge plates 440, 450 were removed for clarity.

As shown in FIGS. 15(*a*)-(*b*), the rotation of hinge plates 420, 440 and the ladder rail 120 attached thereto is unimpeded by the hinge latch 460, which is maintained in the unlocked position by spring plunger 902.

Figure 16A:
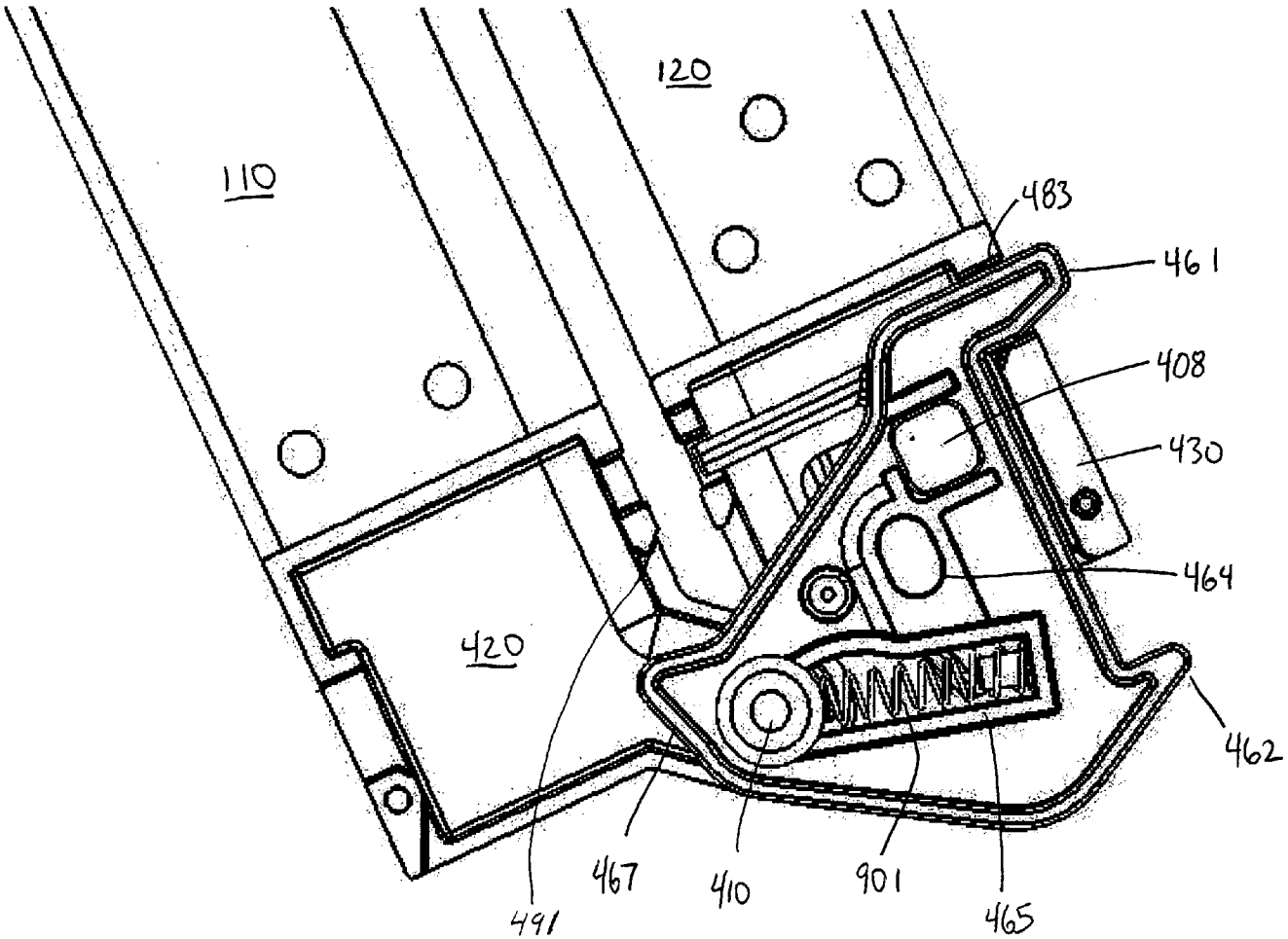
FIG. 16(*a*) shows a view of an open hinge with a hinge latch, in accord with the second example of the present concepts, from a point of view outside of the left ladder rail looking in with some hinge plates removed for clarity.
Figure 16B:
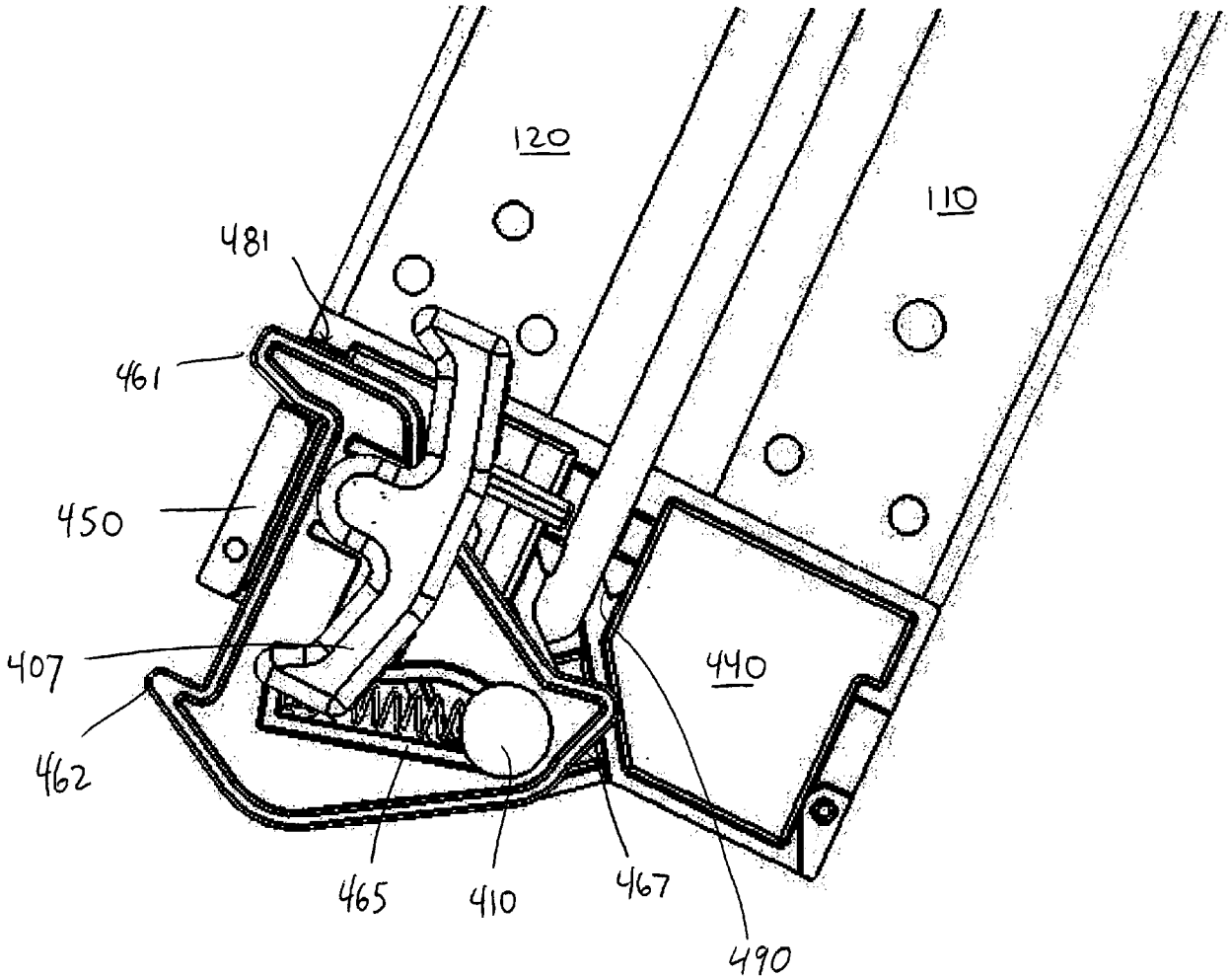

Disengagement of spring plunger 902 is accomplished by co-action of a surface of angled latch portion 467 and angled hinge plate portions 490, 491 of hinge plates 420, 440, respectively, as shown in FIGS. 15(*a*)-15(*b*). Following unlocking of the hinge 400 and rotation of hinge plates 420, 440 toward an open position, a surface of angled latch portion 467 contacts and bears upon angled hinge plate portions 490, 491. As the rotation of the hinge plates 420, 440 relative to the other hinge plates 430, 450 continues, the force imparted by angled hinge plate portions 490, 491 on angled latch portion 467 forces hinge 460 toward the locking position with sufficient force to override the resistance of spring plunger 902 and displace hinge 460 relative to shaft 410 along elongated slot 465 toward a distal end of the elongated slot. Following disengagement of the spring plunger 902 ball from the hinge plate opening 464, the compressed spring 901 biases the hinge 460 toward the locked position wherein the first bottom locking portion 461 engages the opening formed by cutouts 481, 483 in hinge plate pair 450, 430. In the open position, shown in FIGS. 16(*a*)-16(*b*), unaided opening movement of the upper ladder rail relative to the lower ladder rail is prevented by the weight of the components, placement of the center of gravity, and friction. Therefore, separate locks are not required to prevent inadvertent opening of the folded ladder sections, but may nevertheless be advantageously provided in this or in other configurations.

The invention disclosed herein can be practiced by employing conventional materials, methodology and equipment. Accordingly, the details of such materials, equipment and methodology are not set forth herein in detail. In the previous descriptions, numerous specific details of one preferred example, such as specific materials, structures, etc., are set forth to provide a grounding in the present invention. However, it should be recognized that the present invention can be practiced without resorting to the details specifically set forth. In other instances, well known processing structures have not been described in detail, in order not to unnecessarily obscure the present invention. It is to be understood that the present invention is capable of use in various other combinations and environments and is capable of changes or modifications within the scope of the inventive concept as expressed herein.

We claim:

1. A foldable ladder configured for installation in an opening to provide access between one floor or space and another floor or space, comprising:

an upper ladder section having at least one rail;

a lower ladder section having at least one rail;

a locking hinge connecting the rail of the upper ladder section to the rail of the lower ladder section and configured to allow the lower ladder section to fold relative to the upper ladder section, wherein when the upper ladder section and the lower ladder section are fully unfolded, the locking hinge being adjustable between at least two configurations, in a first configuration, the locking hinge completely preventing the lower ladder section from folding relative to the upper ladder section, and in a second configuration, the locking hinge allowing the lower ladder section to fold relative to the upper ladder section; wherein the locking hinge comprises:

a hinge latch positioned between the first and second opposing hinge plates, the hinge latch comprising an angle latch portion and the hinge latch being movable between a locked position and an unlocked position, wherein biasing the hinge latch from the locked position to the unlocked position adjusts the locking hinge from the first configuration to the second configuration;

a plurality of hinge plates;

a first biasing member biasing the hinge latch towards the locked position;

a second biasing member, wherein upon the hinge latch being in the unlocked position, the first biasing member being prevented by the second biasing member from biasing the hinge latch towards the locked position; and a third biasing member, wherein upon rotational movement of the hinge plates the angled latch portion contacts the third biasing member allowing the first biasing member to bias the hinge latch towards the locked position.

2. The foldable ladder according to claim 1, wherein when the angled latch portion contacts the third biasing member the second biasing member disengages thereby allowing the first biasing member to bias the hinge latch towards the locked position.

3. The foldable ladder according to claim 1, wherein the first biasing member comprises a spring.

4. The foldable ladder according to claim 1, wherein the second biasing member is a spring plunger comprising a spring-loaded plunger ball.

5. The foldable ladder according to claim 1, wherein the hinge plates comprise the third biasing member.

6. The foldable ladder according to claim 5, wherein the third biasing member is an angled plate portion of the hinge plates.

* * * * *